US012188724B2

(12) United States Patent
Kim et al.

(10) Patent No.: US 12,188,724 B2
(45) Date of Patent: Jan. 7, 2025

(54) HEAT EXCHANGER AND AIR CONDITIONER INCLUDING THE SAME

(71) Applicant: Samsung Electronics Co., Ltd., Suwon-si (KR)

(72) Inventors: Donghyun Kim, Suwon-si (KR); Youngmin Kim, Suwon-si (KR); Yonghwa Choi, Suwon-si (KR); Jeungku Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 925 days.

(21) Appl. No.: 16/686,913

(22) Filed: Nov. 18, 2019

(65) Prior Publication Data

US 2020/0191489 A1 Jun. 18, 2020

(30) Foreign Application Priority Data

Dec. 14, 2018 (KR) ..... 10-2018-0162239

(51) Int. Cl.

| | |
|---|---|
| ***F28D 1/053*** | (2006.01) |
| ***F24F 11/84*** | (2018.01) |
| ***F28F 9/02*** | (2006.01) |

(52) U.S. Cl.

CPC ..... *F28D 1/05325* (2013.01); *F24F 11/84* (2018.01); *F28F 9/02* (2013.01); *F28D 1/05366* (2013.01)

(58) Field of Classification Search

CPC ..... F28D 1/05325; F28D 1/05375; F28D 1/05366; F24F 11/84; F25B 39/00;

(Continued)

(56) References Cited

U.S. PATENT DOCUMENTS

| | | | |
|---|---|---|---|
| 7,490,662 | B2 | 2/2009 | Eliades et al. |
| 8,113,270 | B2 | 2/2012 | Rios et al. |

(Continued)

FOREIGN PATENT DOCUMENTS

| | | | |
|---|---|---|---|
| CN | 104246413 | A | 12/2014 |
| CN | 104567113 | A | 4/2015 |

(Continued)

OTHER PUBLICATIONS

Chinese Office Action with English translation dated Apr. 6, 2021; Chinese Appln. No. 201911297588.0.

(Continued)

*Primary Examiner* — Tavia Sullens
*Assistant Examiner* — Khaled Ahmed Ali Al Samiri
(74) *Attorney, Agent, or Firm* — Jefferson IP Law, LLP

(57) ABSTRACT

A heat exchanger for an air conditioner includes a plurality of flat heat transfer tubes through which a refrigerant flows; first and second headers disposed on opposite ends of the plurality of flat heat transfer tubes; at least one baffle disposed in at least one of the first and second headers and to partition an inner space of the at least one header; and a refrigerant flow control device disposed on the at least one baffle, to allow the refrigerant to selectively pass through the at least one baffle. The refrigerant flow control device is configured to prevent refrigerant from passing through the refrigerant flow control device when the refrigerant flows in one direction in the header, and to allow the refrigerant to pass through the refrigerant flow control device when the refrigerant flows in a direction opposite to the one direction in the header.

14 Claims, 20 Drawing Sheets

(58) Field of Classification Search
CPC . F25B 13/00; F25B 41/20; F28F 27/02; F28F 9/0209; F28F 9/0212; F28F 9/0273; F28F 9/0275; F28F 9/02; F16K 15/021
See application file for complete search history.

(56) References Cited

U.S. PATENT DOCUMENTS

| | | | |
|---|---|---|---|
| 8,235,101 | B2 | 8/2012 | Taras et al. |
| 9,109,845 | B2 | 8/2015 | Kim et al. |
| 9,555,687 | B2 | 1/2017 | Lim et al. |
| 9,696,095 | B2 | 7/2017 | Lee et al. |
| 9,863,722 | B2 | 1/2018 | Kim et al. |
| 10,017,028 | B2 | 7/2018 | Heyl et al. |
| 10,220,673 | B2 | 3/2019 | Lim et al. |
| 10,551,127 | B2 | 2/2020 | Park et al. |
| 2003/0116308 | A1 | 6/2003 | Watanabe et al. |
| 2010/0206535 | A1* | 8/2010 | Munoz ..... F28F 9/0204 165/173 |
| 2014/0008044 | A1 | 1/2014 | Kim et al. |
| 2014/0069136 | A1 | 3/2014 | Lim et al. |
| 2015/0114030 | A1 | 4/2015 | Park et al. |
| 2015/0251517 | A1 | 9/2015 | Heyl et al. |
| 2015/0345843 | A1 | 12/2015 | Voorhis et al. |
| 2016/0209130 | A1 | 7/2016 | Seo et al. |
| 2017/0096043 | A1 | 4/2017 | Lim et al. |

FOREIGN PATENT DOCUMENTS

| | | | | |
|---|---|---|---|---|
| CN | 105004213 | A | | 10/2015 |
| CN | 105805987 | A | | 7/2016 |
| DE | 10 2012 110 701 | A1 | | 5/2014 |
| IN | 107218745 | A | | 9/2017 |
| JP | H0623806 | U | * | 3/1994 |
| JP | 2000-346568 | A | | 12/2000 |
| JP | 2003021487 | A | * | 1/2003 |
| JP | 2006-112428 | A | | 4/2006 |
| JP | 2013-2774 | A | | 1/2013 |
| KR | 20030050328 | A | * | 6/2003 |
| KR | 10-2007-0091217 | A | | 9/2007 |
| KR | 10-0908769 | B1 | | 7/2009 |
| KR | 10-2013-0085848 | A | | 7/2013 |
| KR | 10-2015-0045753 | A | | 4/2015 |
| KR | 10-2015-0103579 | A | | 9/2015 |
| KR | 10-1766617 | B1 | | 8/2017 |
| KR | 10-1936243 | B1 | | 1/2019 |
| WO | 2013/162222 | A1 | | 10/2013 |

OTHER PUBLICATIONS

European Search Report dated Apr. 21, 2020; European Appln. No. 19213611.7-1008.

Korean Office Action with English translation dated Apr. 27, 2023; Korean Appln. No. 10-2018-0162239 .

* cited by examiner

HEAT EXCHANGER AND AIR CONDITIONER INCLUDING THE SAME

CROSS-REFERENCE TO RELATED APPLICATION

This application is based on and claims priority under 35 U.S.C. § 119 to Korean Patent Application No. 10-2018-0162239, filed on Dec. 14, 2018, in the Korean Intellectual Property Office, the disclosure of which is incorporated by reference herein in its entirety.

BACKGROUND

1. Field

Apparatuses consistent with the disclosure relate to a heat exchanger for an air conditioner, and more particularly, to a heat exchanger having a variable path and an air conditioner including the same.

2. Description of the Related Art

An outdoor unit of an air conditioner for cooling and heating may serve to dissipate heat absorbed by an indoor unit to lower an indoor temperature in cooling operation and may serve to transfer absorbed heat to the indoor device to raise the indoor temperature in heating operation.

The outdoor unit may include a refrigerant compressor compressing and circulating a refrigerant, a heat exchanger performing heat transfer between outdoor air and the refrigerant, and a fan forcibly blowing air to the heat exchanger. The heat exchanger of the outdoor unit may perform heat exchange in two forms. That is, the heat exchanger is used as a refrigerant condenser condensing a high-temperature and high-pressure gaseous refrigerant into a liquid refrigerant in the cooling operation, and is used as a refrigerant evaporator evaporating a low-temperature and low-pressure liquid refrigerant in the heating operation. Therefore, the heat exchanger of the outdoor unit of the air conditioner for cooling and heating needs to be able to serve as both of the condenser and the evaporator.

In the heat exchanger of the outdoor unit according to the related art, only a direction of a flow of the refrigerant is reversed and a path through which the refrigerant flows is not changed in the cooling or heating operation.

FIG. 1 is a conceptual view illustrating the case where a heat exchanger according to the related art is used as a condenser, and FIG. 2 is a conceptual view illustrating the case where the heat exchanger according to the related art is used as an evaporator.

Referring to FIGS. 1 and 2, a heat exchanger 1 includes a plurality of tubes 2 which are vertically stacked and in which a refrigerant flows, and a first header 3 and a second header 4 disposed on opposite ends of the plurality of tubes 2, respectively. A first port pipe 5 and a second port pipe 6 through which the refrigerant flows in and out may be provided on the first header 3. Further, two baffles 7 and 8 are disposed in the first header 3 and one baffle 9 is disposed in the second header 4. Therefore, the plurality of tubes 2 are partitioned into four tube groups by the three baffles 7, 8 and 9. That is, the plurality of tubes 2 may be partitioned into a first tube group 2-1, a second tube group 2-2, a third tube group 2-3, and a fourth tube group 2-4 arranged in this order from the top.

In the case where the heat exchanger 1 is used as a condenser as illustrated in FIG. 1, the refrigerant flows in through the first port pipe 5 of the first header 3 and flows to the second header 4 through the first tube group 2-1 (P1). The refrigerant flowing into the second header 4 flows to the first header 3 through the second tube group 2-2 (P2). The refrigerant flowing into the first header 3 flows to the second header 4 through the third tube group 2-3 (P3). The refrigerant flowing into the second header 4 flows to the first header 3 through the fourth tube group 2-4 (P4) and is discharged to the outside through the second port pipe 6.

In the case where the heat exchanger 1 is used as a condenser as illustrated in FIG. 2, the refrigerant flows in through the second port pipe 6 of the first header 3 and flows to the second header 4 through the fourth tube group 2-4 (P1). The refrigerant flowing into the second header 4 flows to the first header 3 through the third tube group 2-3 (P2). The refrigerant flowing into the first header 3 flows to the second header 4 through the second tube group 2-2 (P3). The refrigerant flowing into the second header 4 flows to the first header 3 through the first tube group 2-1 (P4), and is discharged to the outside through the first port pipe 5.

As illustrated in FIGS. 1 and 2, in the heat exchanger 1 according to the related art, only a direction of the flow of the refrigerant is reversed in cooling operation as compared to that in heating operation, and paths P1, P2, P3, and P4 through which the refrigerant flows are not changed. Here, a movement in which the refrigerant moves from the first header 3 or the second header 4 to the second header 4 or the first header 3 through the plurality of tubes 2 is defined as one turn. Accordingly, the number of times of the movement of the refrigerant in the case where the heat exchanger 1 is used as the condenser is four turns, and the number of times of the movement of the refrigerant in the case where the heat exchanger 1 is used as the evaporator is four turns as well. That is, the number of times of the movement is the same in both of the case where the heat exchanger 1 according to the related art is used as the evaporator and the case where the heat exchanger 1 according to the related art is used as the condenser.

A loss in heat exchange resulting from a pressure loss under an evaporation condition is usually larger than a loss in heat exchange under a condensation condition, and thus it is preferred that the optimal number of turns of the evaporation condition is smaller than the optimal number of turns of the condensation condition.

However, the heat exchanger according to the related art is manufactured based on the number of turns resulting from a compromise between the evaporation condition and the condensation condition, and thus the loss may occur under the condensation condition in the case where the optimum evaporation condition is set, and the loss may occur under the evaporation condition in the case where the optimum condensation condition is set. As a result, it is difficult to satisfy both of the conditions.

SUMMARY

Embodiments of the disclosure overcome the above disadvantages and other disadvantages not described above. Also, the disclosure is not required to overcome the disadvantages described above, and an embodiment of the disclosure may not overcome any of the problems described above.

The disclosure provides a heat exchanger for an air conditioner in which a length of a refrigerant flow path may vary depending on a refrigerant flow direction without an external control device such as an electronic valve.

Further, the disclosure provides a heat exchanger for an air conditioner in which a uniform refrigerant flow distribution may be implemented in a variable path section in the case where the heat exchanger is operated under an evaporation condition.

Further, the disclosure provides a heat exchanger for an air conditioner, which includes a refrigerant flow control device that may be disposed inside a header such that failure rarely occurs and an efficient use of an installation space is possible.

According to an embodiment of the disclosure, a heat exchanger for an air conditioner includes: a plurality of flat heat transfer tubes through which a refrigerant flows; a plurality of fins configured to be arranged on outer surfaces of the plurality of flat heat transfer tubes; first and second headers configured to be disposed on opposite ends of the plurality of flat heat transfer tubes, respectively; at least one baffle configured to be disposed in at least one of the first header or the second header and partition an inner space of the at least one header; and a refrigerant flow control device configured to be disposed on the at least one baffle, allow the refrigerant to selectively pass through the at least one baffle, and control a flow of the refrigerant, wherein the refrigerant flow control device is configured to block the flow of the refrigerant to prevent the refrigerant from passing through the refrigerant flow control device in the case where the refrigerant flows in one direction in the at least one header, allow the refrigerant to pass through the at least one baffle through the refrigerant flow control device in the case where the refrigerant flows in a direction opposite to the one direction in the at least one header, and control a flow rate of the refrigerant passing through the refrigerant flow control device.

The refrigerant flow control device may include: a communicating pipe disposed on the at least one baffle; a check valve disposed in the communicating pipe and opening and closing the communicating pipe depending on a flow direction of the refrigerant; and a refrigerant flow rate adjusting member disposed on one end of the communicating pipe, having a hollow cylindrical shape communicating with the communicating pipe, and having a side surface in which refrigerant passages through which the refrigerant passes are formed.

The check valve may include a valve seat fixed in the communicating pipe and having a through-hole; a cylinder extending vertically from the valve seat and having an outer circumferential surface in which a plurality of refrigerant holes are formed; and a plunger slidably disposed in the cylinder to selectively close the through-hole of the valve seat depending on the flow direction of the refrigerant, and in the case where the refrigerant flows in the direction opposite to the one direction in the at least one header, the refrigerant may lift the plunger to pass through the communicating pipe through the through-hole of the valve seat, and the plurality of refrigerant holes of the cylinder.

A conical hole is formed on one side of the through-hole, and a conical portion having a conical shape corresponding to the conical hole of the through-hole may be formed at one end of the plunger.

A stopper limiting a movement of the plunger may be formed at one end of the cylinder.

The refrigerant flow rate adjusting member may be implemented by a hollow refrigerant pipe, and a plurality of through-holes may be formed in the refrigerant pipe as the refrigerant passages.

The refrigerant flow rate adjusting member may be a hollow porous pipe formed of a porous member.

A length from the at least one baffle to one end of the refrigerant flow rate adjusting member may be determined to allow the one end of the refrigerant flow rate adjusting member to be in contact with a virtual plane extending from a baffle disposed in the opposite header.

First and second port pipes through which the refrigerant flows in or out may be disposed on a lower end portion and an upper end portion of the first header, respectively, the at least one baffle may include first and second baffles disposed in the first header, and a third baffle disposed in the second header, and the at least one refrigerant flow control device may include a first refrigerant flow control device disposed on the third baffle of the second header, and a second refrigerant flow control device disposed on the second baffle of the first header disposed adjacent to the second port pipe.

A refrigerant flow rate adjusting member of the first refrigerant flow control device may extend toward a lower end of the second header, and a refrigerant flow rate adjusting member of the second refrigerant flow control device may extend toward an upper end of the first header.

The refrigerant flow rate adjusting member of the second refrigerant flow control device may be connected to the second port pipe.

The further away from the check valve, the larger the area of a plurality of through-holes of the refrigerant flow rate adjusting member of the second refrigerant flow control device may be.

The heat exchanger may further include: a plurality of other flat heat transfer tubes disposed parallel to the plurality of flat heat transfer tubes; and third and fourth headers disposed on opposite ends of the plurality of other flat heat transfer tubes, respectively, wherein first and second port pipes through which the refrigerant flows in or out are disposed at a lower end portion of the first header and an upper portion of the fourth header, respectively, and an upper end portion of the second header and a lower end portion of the third header are connected to each other through a connecting pipe.

The at least one baffle may include a first baffle disposed in the first header and a second baffle disposed in the second header, and the at least one refrigerant flow control device may include a first refrigerant flow control device disposed on the first baffle of the first header, and a second refrigerant flow control device disposed on the second baffle of the second header.

A refrigerant flow rate adjusting member of the first refrigerant flow control device may be connected to the first port pipe and a refrigerant flow rate adjusting member of the second refrigerant flow control device may be connected to the connecting pipe.

In the heat exchanger for an air conditioner according to an embodiment of the disclosure having the above-described structure, a refrigerant moving path varies depending on a refrigerant flow direction, such that in the case where the heat exchanger is used as an evaporator, it is possible to decrease the number of turns of the moving path in comparison to the case where the heat exchanger is used as a condenser.

Further, in the heat exchanger for an air conditioner according to an embodiment of the disclosure, a refrigerant flow rate may be adjusted by using the refrigerant flow rate adjusting member, such that it is possible to implement a relatively uniform refrigerant flow distribution in the variable path section.

Additional and/or other aspects and advantages of the disclosure will be set forth in part in the description which follows and, in part, will be obvious from the description, or may be learned by practice of the disclosure.

BRIEF DESCRIPTION OF THE DRAWING FIGURES

The above and/or other embodiments of the disclosure will be more apparent by describing certain embodiments of the disclosure with reference to the accompanying drawings, in which.

Figure 19:
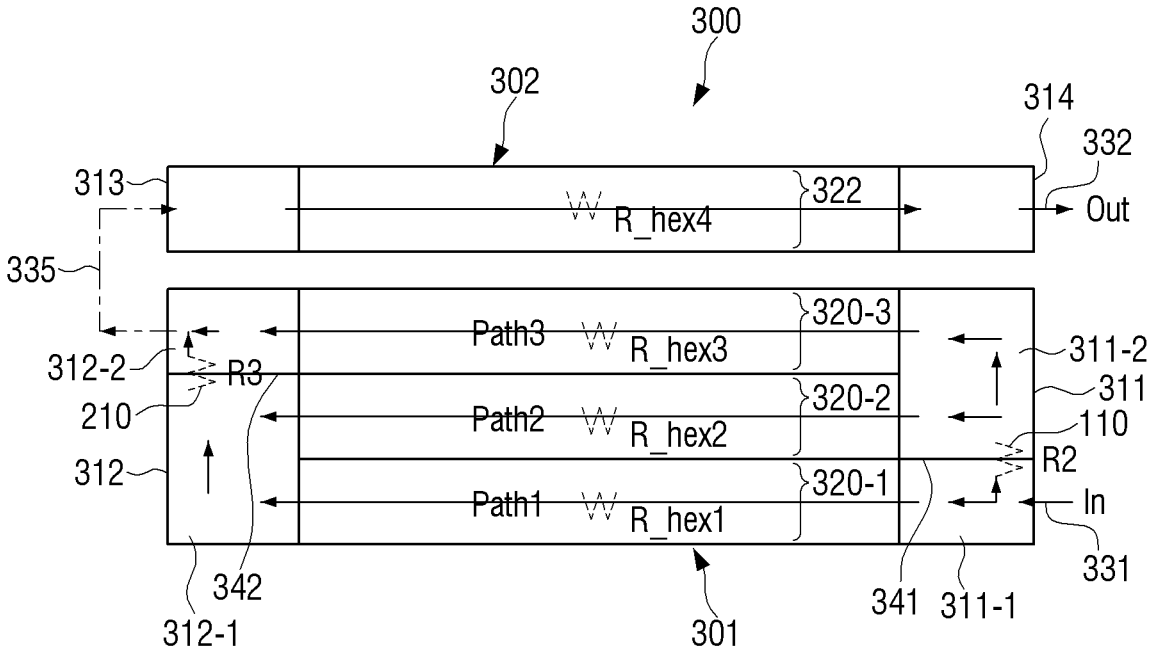
Figure 20:
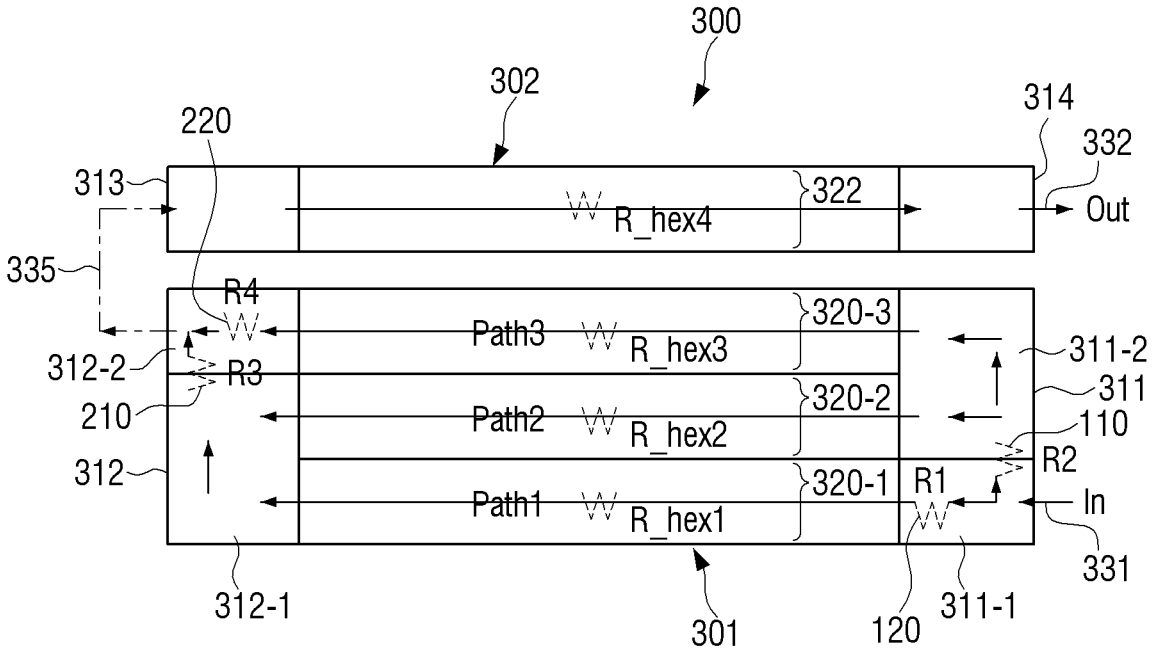

FIG. 19 is a conceptual view for describing a resistance of a refrigerant moving path in the case where the heat exchanger for an air conditioner according to another embodiment of the disclosure that does not include the refrigerant flow rate adjusting member is used as an evaporator; and FIG. 20 is a conceptual view for describing a resistance of a refrigerant moving path in the case where the heat exchanger for an air conditioner according to another embodiment of the disclosure that includes the refrigerant flow rate adjusting member is used as an evaporator.

DETAILED DESCRIPTION OF THE EXEMPLARY EMBODIMENTS

Hereinafter, a heat exchanger and an air conditioner including the same according to embodiments of the disclosure will be described in detail with reference to the accompanying drawings.

Embodiments described below are illustratively provided to assist in understanding of the disclosure, and it is to be understood that the disclosure may be variously modified and executed in a different form from the embodiments described herein. However, in the case where it is considered that a detailed description of relevant known functions or components may obscure the gist of the disclosure, the detailed description and concrete illustration thereof will be omitted. Further, the accompanying drawings are not illustrated to scale, but sizes of some of components may be exaggerated to assist in the understanding of the disclosure.

In the disclosure, the terms "first, second, and so forth" are used to describe diverse elements regardless of their order and/or importance and to discriminate one element from other elements, but are not limited to the corresponding elements. For example, a first user appliance and a second user appliance may indicate different user appliances regardless of their order or importance. For example, without departing from the scope of the disclosure, the first element may be called the second element, and the second element may be called the first element in a similar manner.

The terms used in the disclosure are used to merely describe various examples, but is not intended to limit the scope of other examples. In the disclosure, a singular expression may include a plural expression unless specially described. All terms (including technical and scientific terms) used in the disclosure could be used as commonly understood by those ordinary skilled in the art to which the disclosure belongs. The terms that are used in the disclosure and are defined in a general dictionary may be used as meanings that are identical or similar to the meanings of the terms from the context of the related art, and they are not interpreted ideally or excessively unless they have been clearly and specially defined. Even the wordings that are defined in the present disclosure must not be interpreted to exclude all examples of the disclosure.

Figure 1:
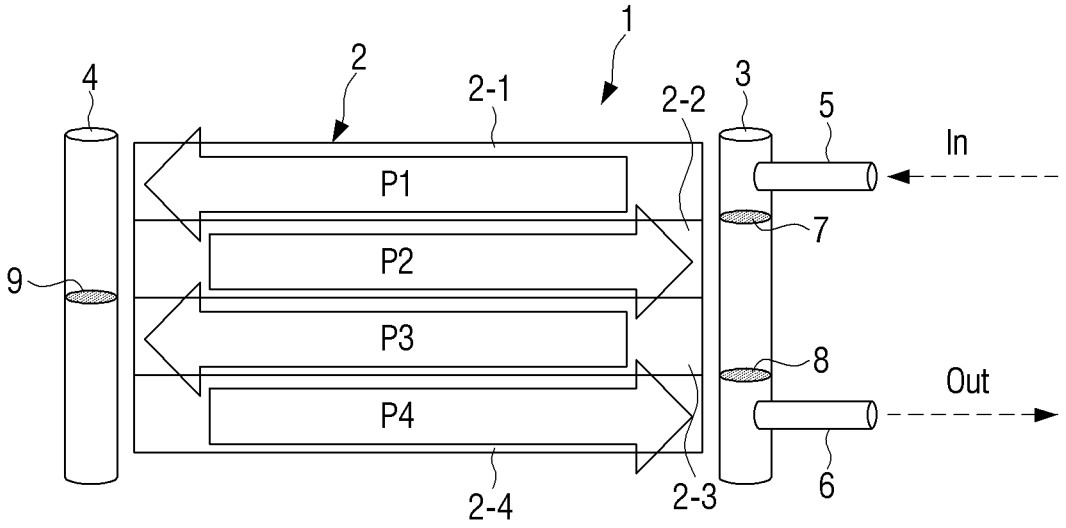
FIG. 1 (RELATED ART)
FIG. 1 is a conceptual view illustrating the case where a heat exchanger according to the related art is used as a condenser.
Figure 2:
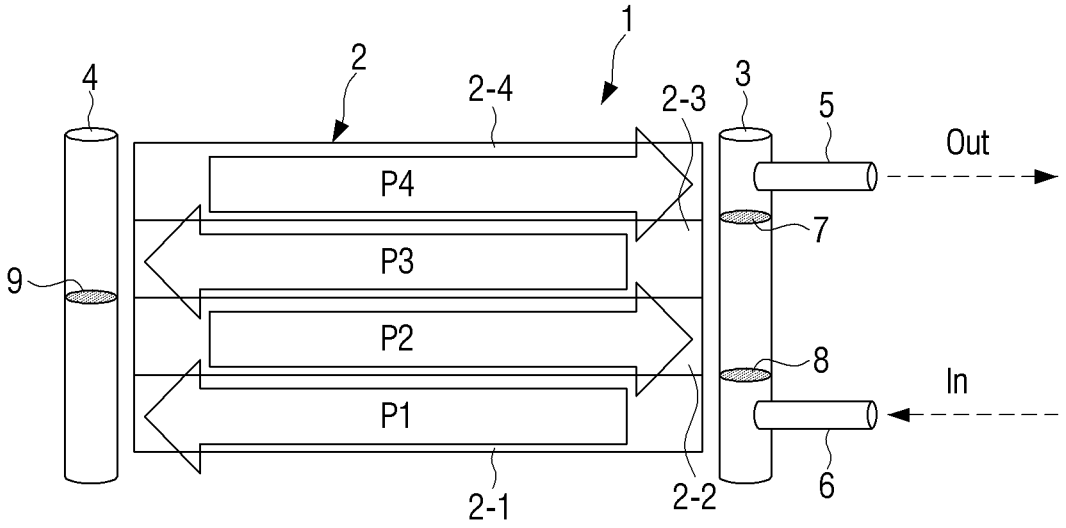
FIG. 2 (RELATED ART)
FIG. 2 is a conceptual view illustrating the case where the heat exchanger according to the related art is used as an evaporator.
Figure 3:
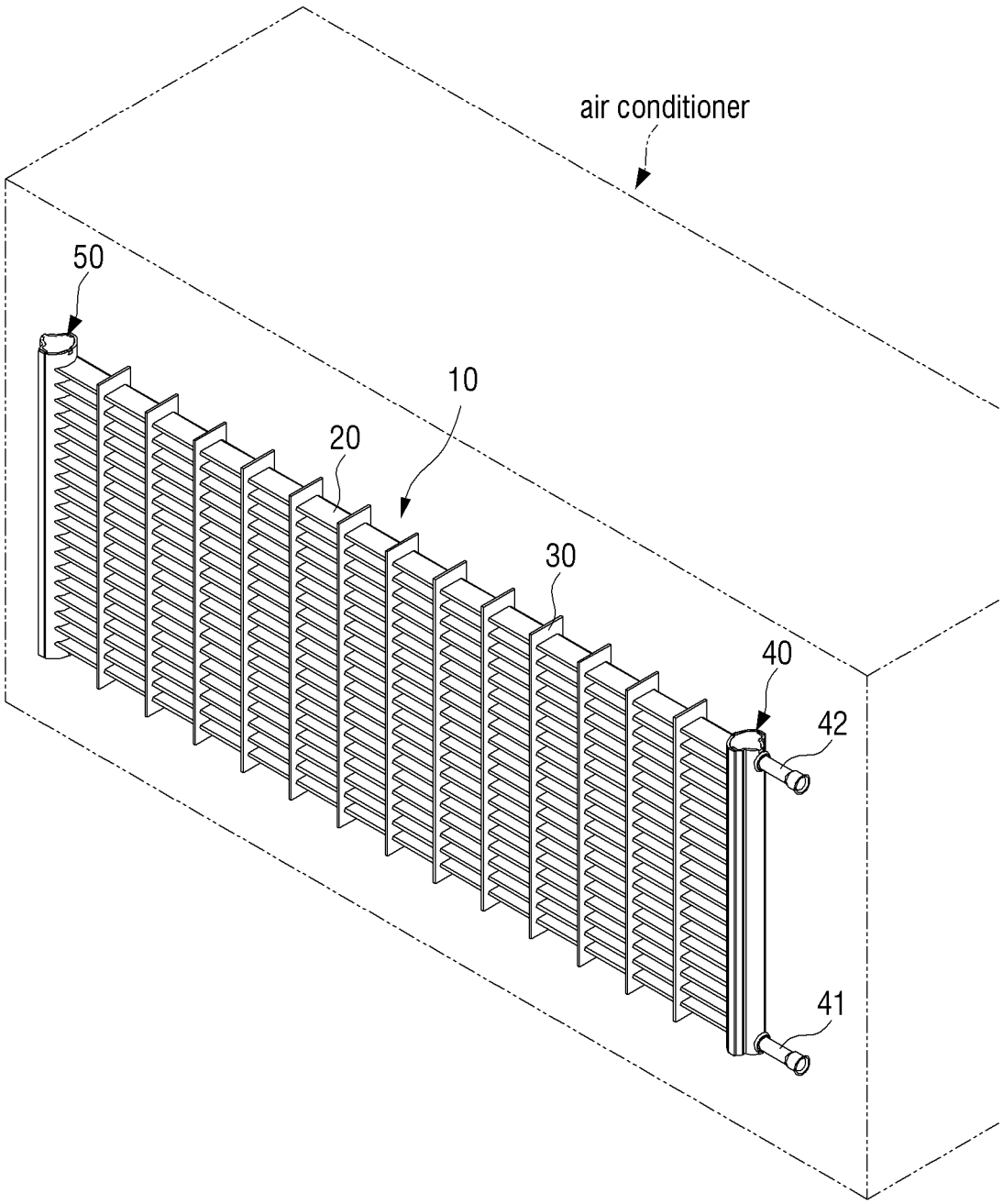
FIG. 3 is a perspective view illustrating a heat exchanger for an air conditioner according to an embodiment of the disclosure.
Figure 4:
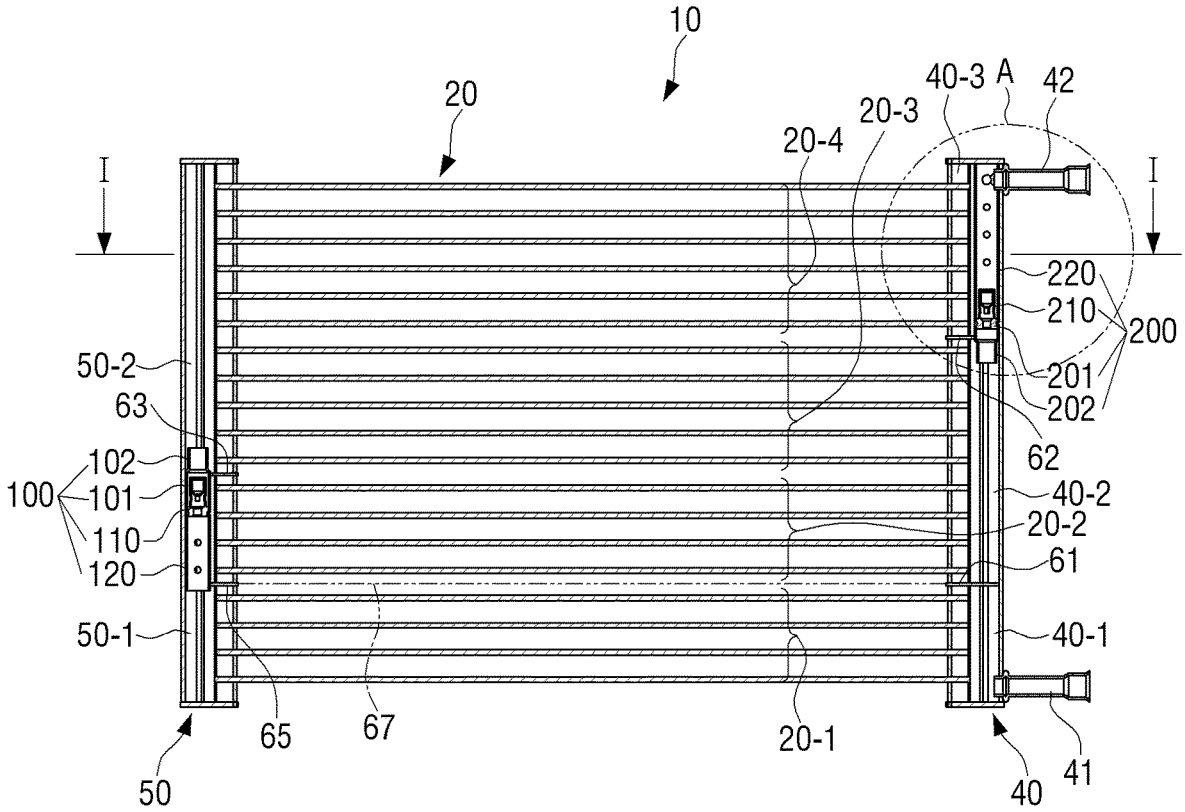
FIG. 4 is a cross-sectional view of the heat exchanger for an air conditioner of FIG. 3.
Figure 5:
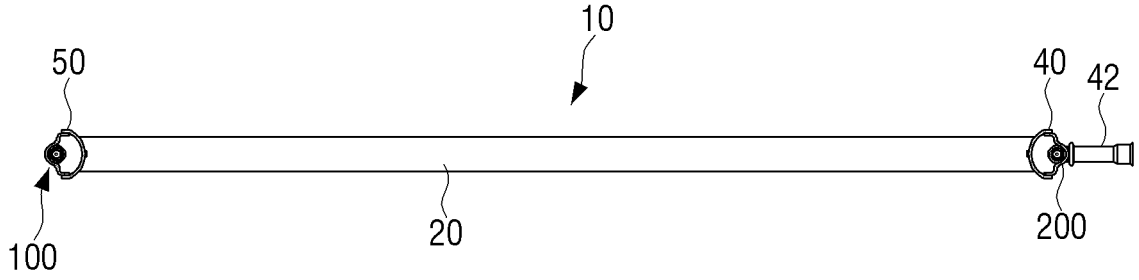
FIG. 5 is a cross-sectional view of the heat exchanger for an air conditioner of FIG. 4 taken along line I-I.
Figure 6:
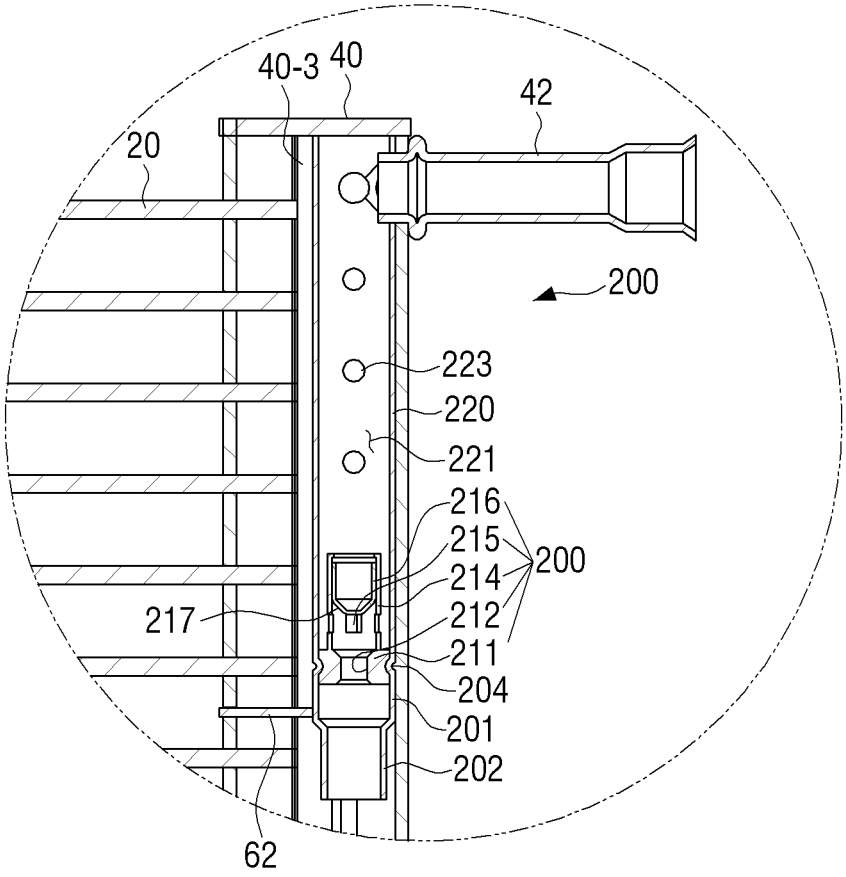
FIG. 6 is a partially enlarged cross-sectional view illustrating a part A of FIG. 4.

FIG. 3 is a perspective view illustrating a heat exchanger for an air conditioner according to an embodiment of the disclosure. FIG. 4 is a cross-sectional view of the heat exchanger for an air conditioner of FIG. 3, and FIG. 5 is a cross-sectional view of the heat exchanger for an air conditioner of FIG. 4 taken along line I-I. FIG. 6 is a partially enlarged cross-sectional view illustrating a part A of FIG. 4. Note that a plurality of fins 30 are not illustrated in FIGS. 4 and 5 for convenience of illustration.

Referring to FIGS. 3 to 5, a heat exchanger 10 for an air conditioner according to an embodiment of the disclosure may include a plurality of flat heat transfer tubes 20, the plurality of fins 30, a first header 40, and a second header 50.

The plurality of flat heat transfer tubes 20, which are tubes in which a refrigerant flows, are disposed parallel to each other in a horizontal direction between the first header 40 and the second header 50. The plurality of flat heat transfer tubes 20 are stacked and spaced at predetermined intervals between the first header 40 and the second header 50. Each of the plurality of flat heat transfer tubes 20 may include a flat and substantially rectangular body, and a plurality of ribs partitioning an inner space of the body into a plurality of refrigerant flow paths.

The plurality of fins 30 are arranged at predetermined intervals on outer surfaces of the plurality of flat heat transfer tubes 20. That is, the plurality of fins 30 are disposed perpendicular to the plurality of flat heat transfer tubes 20, between the first header 40 and the second header 50.

The first header 40 is disposed on one ends of the plurality of flat heat transfer tubes 20, and the second header 50 is disposed on the other ends of the plurality of flat heat transfer tubes 20. That is, the second header 50 is spaced apart from the first header 40 by a length of the flat heat transfer tube 20. The first header 40 and the second header 50 each extend to a predetermined length in a vertical direction and each have a hollow tube shape.

An inner space of each of the first header 40 and the second header 50 communicates with the plurality of flat heat transfer tubes 20 to allow the refrigerant to flow. Therefore, the refrigerant in the first header 40 or the second header 50 may flow into the plurality of flat heat transfer tubes 20, and the refrigerant passing through the plurality of flat heat transfer tubes 20 may flow into the first header 40 or the second header 50.

A first port pipe 41 and a second port pipe 42 through which the refrigerant flows into or is discharged from the first header 40 may be disposed on the first header 40. The first port pipe 41 may be disposed at a lower end portion of the first header 40 and the second port pipe 42 may be disposed at an upper end portion of the first header 40. In this embodiment, the case where the first port pipe 41 and the second port pipe 42 are both disposed on the first header 40 is described. However, as another example, the first port pipe 41 may be disposed on the first header 40 and the second port pipe 42 may be disposed on the second header 50.

One or more baffles 61, 62, and 63 partitioning the inner space of the header 40 or 50 into two or more spaces may be disposed in at least one of the first header 40 and the second header 50. In the heat exchanger 10 according to the embodiment of the disclosure illustrated in FIG. 4, the first header 40 includes two baffles 61 and 62 and the second header 50 includes one baffle 63. The baffle 61, 62, or 63 blocks the inner space of the header 40 or 50 to prevent the refrigerant from passing through the baffle 61, 62, or 63 and flowing in the header 40 or 50. The first header 40 is partitioned into three spaces including a lower space 40-1, a middle space 40-2, and an upper space 40-3 by two baffles, that is, the first baffle 61 and the second baffle 62. The second header 50 is partitioned into two spaces including an upper space 50-2 and a lower space 50-1 by one baffle, that is, the third baffle 63.

Further, the plurality of flat heat transfer tubes 20 may be partitioned into four flat heat transfer tube groups by the three baffles 61, 62, and 63. Specifically, the plurality of flat heat transfer tubes 20 disposed between a lower end of the first header 40 and the first baffle 61 of the first header 40 are grouped into a first flat heat transfer tube group 20-1, the plurality of flat heat transfer tubes 20 disposed between the first baffle 61 of the first header 40 and the third baffle 63 of the second header 50 are grouped into a second flat heat transfer tube group 20-2, the plurality of flat heat transfer tubes 20 disposed between the third baffle 63 of the second header 50 and the second baffle 62 of the first header 40 are grouped into a third flat heat transfer tube group 20-3, and the plurality of flat heat transfer tubes 20 disposed between the second baffle 62 of the first header 40 and an upper end of the first header 40 are grouped into a fourth flat heat transfer tube group 20-4. Flow directions of the refrigerant passing through the plurality of flat heat transfer tubes 20 grouped into each flat heat transfer tube group 20-1, 20-2, 20-3, or 20-4 are the same as each other. For example, the refrigerant passing through the plurality of flat heat transfer tubes 20 grouped into the first flat heat transfer tube group 20-1 flows in the same direction.

A refrigerant flow control device 100 or 200 which allows the refrigerant to selectively pass through the baffle to control a refrigerant flow may be disposed in at least one of the plurality of baffles 61, 62, and 63 disposed in the headers 40 and 50. The refrigerant flow control devices 100 and 200 block the refrigerant from passing through the refrigerant flow control devices 100 and 200 to function as baffles, in the case where the refrigerant flows in one direction in the headers 40 and 50. The refrigerant flow control devices 100 and 200 are operated to allow the refrigerant to pass through the refrigerant flow control devices 100 and 200 to make the spaces inside the header partitioned by the baffle communicate with each other, in the case where the refrigerant flows in a direction opposite to the one direction in the headers 40 and 50. Further, the refrigerant flow control devices 100 and 200 may perform a function of controlling a flow rate of the refrigerant passing through the refrigerant flow control devices 100 and 200, respectively.

In this embodiment, the refrigerant flow control device 100 is disposed on the third baffle 63 of the second header 50, and the refrigerant flow control device 200 is disposed on the second baffle 62 of the first header 40, and no refrigerant flow control device is disposed on the first baffle 61 of the first header 40 as illustrates in FIG. 4.

Hereinafter, the refrigerant flow control device used in the heat exchanger according to the embodiment of the disclosure will be described in detail with reference to FIGS. 7 to 10.

Figure 7:
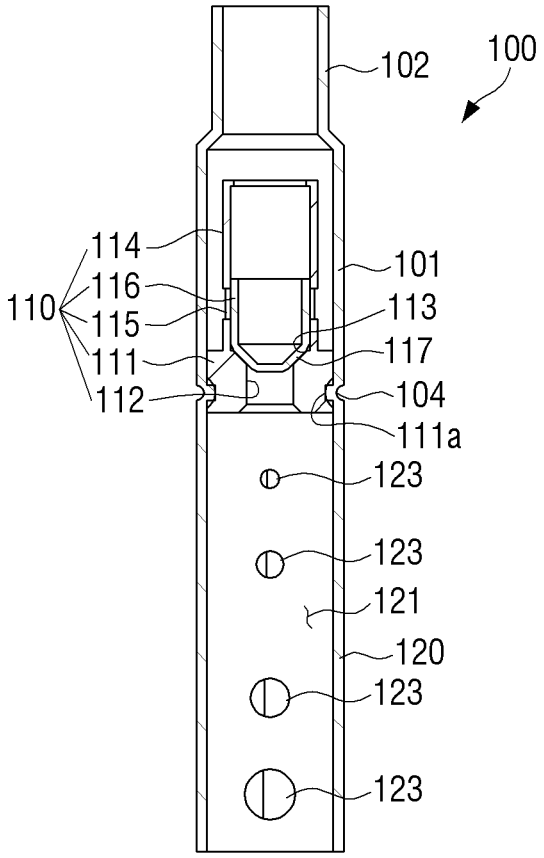
FIG. 7 is a cross-sectional view illustrating a refrigerant flow control device used in the heat exchanger for an air conditioner according to the embodiment of the disclosure.
Figure 8:
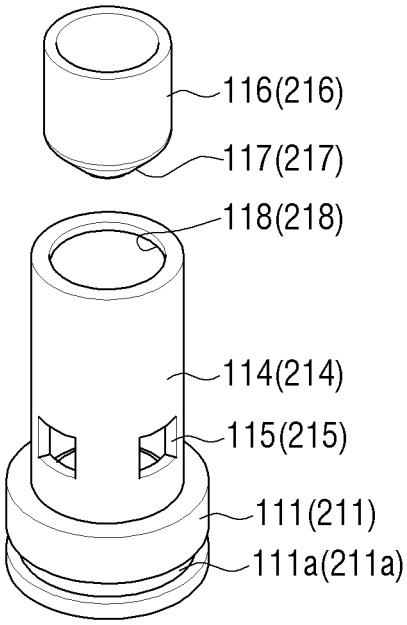
FIG. 8 is an exploded perspective view illustrating a check valve of the refrigerant flow control device of FIG. 7.
Figure 9:
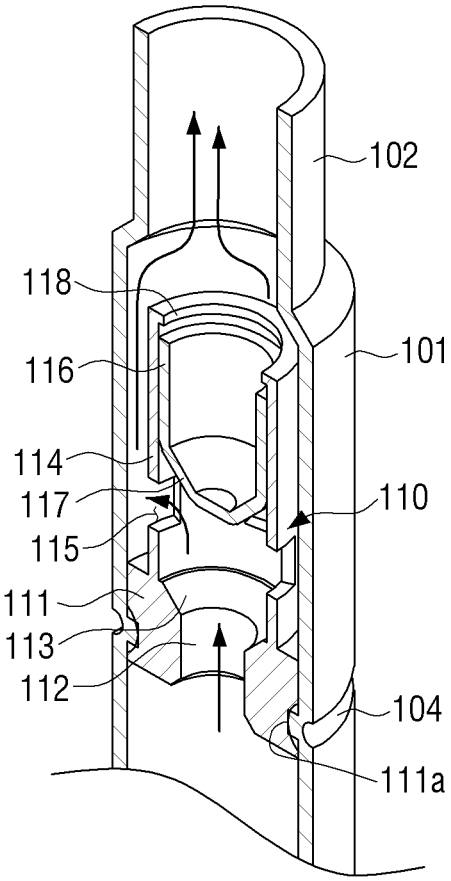
FIG. 9 is a partial cross-sectional perspective view illustrating a state in which the check valve of the refrigerant flow control device of FIG. 7 is opened.
Figure 10:
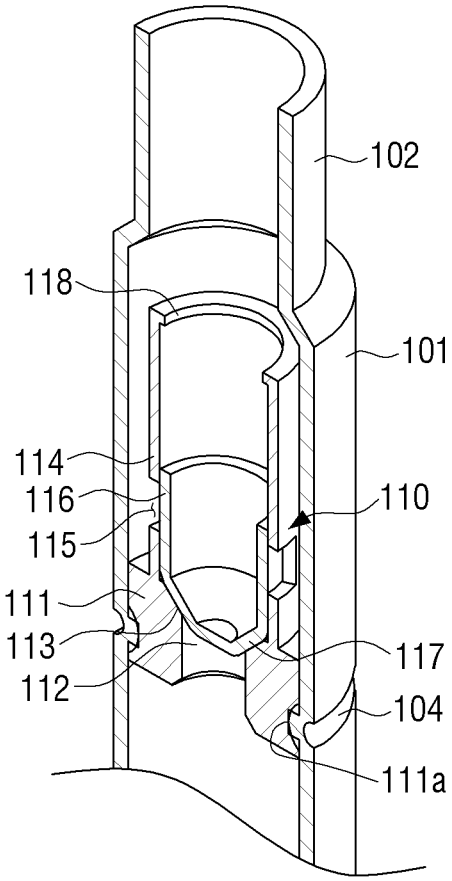
FIG. 10 is a partial cross-sectional perspective view illustrating a state in which the check valve of the refrigerant flow control device of FIG. 7 is closed.

FIG. 7 is a cross-sectional view illustrating the refrigerant flow control device used in the heat exchanger for an air conditioner according to an embodiment of the disclosure. FIG. 8 is an exploded perspective view illustrating a check valve of the refrigerant flow control device of FIG. 7. FIG. 9 is a partial cross-sectional perspective view illustrating a state in which the check valve of the refrigerant flow control device of FIG. 7 is opened, and FIG. 10 is a partial cross-sectional perspective view illustrating a state in which the check valve of the refrigerant flow control device of FIG. 7 is closed.

Referring to FIG. 7, the refrigerant flow control device 100 used in the heat exchanger 10 according to the embodiment of the disclosure may include a communicating pipe 101, a check valve 110, and a refrigerant flow rate adjusting member 120. The refrigerant flow control device 100 illustrated in FIG. 7 may be disposed on the third baffle 63 of the second header 50.

The communicating pipe 101 has a hollow pipe shape with a circular cross section and is fixed to the baffle 63. The communicating pipe 101 connects the header space 50-1 (hereinafter, referred to as a header lower space) below the baffle 63 and the header space 50-2 (hereinafter, referred to as a header upper space) over the baffle 63 to each other to function as a passage through which the refrigerant in the header space 50-1 below the baffle 63 moves to the header space 50-2 over the baffle 63. The communicating pipe 101 may include a protruding portion 102 penetrating through the baffle 63 and protruding toward the opposite header space 50-2. A diameter of the protruding portion 102 may be smaller than a diameter of the communicating pipe 101.

The check valve 110 is disposed in the communicating pipe 101 and selectively opens and closes the communicating pipe 101. Specifically, the check valve 110 opens the communicating pipe 101 to allow the refrigerant to pass through the communicating pipe 101 or blocks the communicating pipe 101 to prevent the refrigerant from passing through the communicating pipe 101 depending on a direction in which the refrigerant flows in the header 50. For example, in the case where the heat exchanger 10 functions as a condenser, the check valve 110 blocks the communicating pipe 101 to prevent the refrigerant in the header lower space 50-1 from moving to the header upper space 50-2, and in the case where the heat exchanger 10 functions as an evaporator, the check valve 110 opens the communicating pipe 101 to allow the refrigerant in the header lower space 50-1 to move to the header upper space 50-2 through the communicating pipe 101.

Referring to FIGS. 7 and 8, the check valve 110 may include a valve seat 111 fixed to the communicating pipe 101, a cylinder 114 extending vertically from the valve seat 111, and a plunger 116 disposed in the cylinder 114.

The valve seat 111 has a cylindrical shape and a through-hole 112 through which the refrigerant may pass is formed in the center of the valve seat 111. A conical hole 113 tapering inwardly from an outer surface side of the valve seat 111 to an inner side of the valve seat 111 is formed on one side of the through-hole 112, that is, in one surface of the valve seat 111 on which the cylinder 114 is disposed. In other words, the through-hole 112 may be constituted by the circular hole and the conical hole 113. A groove 111*a* may be formed along an entire circumference of an outer circumferential surface of the valve seat 111 facing an inner surface of the communicating pipe 101. A protrusion 104 inserted into the groove 111*a* of the valve seat 111 is formed on the entire circumference of the communicating pipe 101 to fix the valve seat 111 to the communicating pipe 101, such that it is possible to prevent the refrigerant from being leaked between the valve seat and the inner surface of the communicating pipe.

The cylinder 114 has an inner diameter corresponding to the conical hole 113 of the through-hole 112 described above, and extends vertically from an upper surface of the valve seat 111 in which the through-hole 112 is formed. The cylinder 114 may be formed integrally with the valve seat 111. A plurality of refrigerant holes 115 are formed in an outer circumferential surface of the cylinder 114 in a circumferential direction. A stopper 118 limiting a movement of the plunger 116 may be formed at an upper end of the cylinder 114. Once one end of the plunger 116 comes into contact with the stopper 118, all of the plurality of refrigerant holes 115 formed in the outer circumferential surface of the cylinder 114 are opened. Further, as the stopper 118 is formed at the upper end of the cylinder 114, it is possible to prevent the plunger 116 from escaping from the cylinder 114.

Meanwhile, an outer surface of the cylinder 114 is spaced apart from the inner surface of the communicating pipe 101 by a predetermined distance, such that the refrigerant discharged through the plurality of refrigerant holes 115 may flow between the cylinder 114 and the communicating pipe 101 smoothly.

The plunger 116 is slidably disposed in the cylinder 114 to selectively close the through-hole 112 of the valve seat 111. The plunger 116 has a hollow cylindrical shape and one end thereof is closed. The plunger 116 selectively opens and closes the through-hole 112 of the valve seat 111 depending on a flow direction of the refrigerant flowing in the header 50. The closed end of the plunger 116, that is, one end of the plunger 116 that faces the upper surface of the valve seat 111 may have a conical shape corresponding to the conical hole 113 of the valve seat 111. Specifically, a conical portion 117 formed at one end of the plunger 116 has the same angle as that of the conical hole 113 of the valve seat 111 and a sufficient length. Therefore, the conical portion 117 of the plunger 116 may come into close contact with the conical hole 113 of the valve seat 111 to prevent the refrigerant from flowing into the through-hole 112. As illustrated in FIG. 10, a side surface of the plunger 116 closes the plurality of refrigerant holes 115 of the cylinder 114 when the plunger 116 is positioned in the conical hole 113 of the valve seat 111.

In the case where the refrigerant moves from the upper space of the header to the lower space of the header, a state in which a pressure of the refrigerant in the header space 50-2 over the baffle 63 on which the refrigerant flow control device 100 is disposed is higher than a pressure of the refrigerant in the header space 50-1 below the baffle 63 is maintained. In this case, the plunger 116 moves downward in the cylinder 114 by the pressure of the refrigerant in the header upper space 50-2 to come into close contact with the conical hole 113 of the valve seat 111, thereby closing the plurality of refrigerant holes 115 of the cylinder 114 as illustrated in FIG. 10. As a result, the refrigerant in the header upper space 50-2 may not flow into the header lower space 50-1 through the refrigerant flow control device 100.

Meanwhile, in the case where the refrigerant moves from the lower space of the header 50 to the upper space of the header 50, a state in which a pressure of the refrigerant in the header space 50-1 below the baffle 63 on which the refrigerant flow control device 100 is disposed is higher than a pressure of the refrigerant in the header space 50-2 over the baffle 63 is maintained. In this case, the plunger 116 moves upward in the cylinder 114 by the pressure of the refrigerant in the header lower space 50-1 to thereby open the conical hole 113 of the valve seat 111 and the plurality of refrigerant holes 115 of the cylinder 114 as illustrated in FIG. 9. As a result, the refrigerant in the header lower space 50-1 may move to the header upper space 50-2 through the through-hole 112 and the plurality of refrigerant holes 115 of the refrigerant flow control device 100. That is, in the case where the pressure of the refrigerant in the header lower space 50-1 is higher than the pressure of the refrigerant in the header upper space 50-2, the refrigerant in the header lower space 50-1 lifts the plunger 116 to open the through-hole 112 of the valve seat 111 and the plurality of refrigerant holes 115 of the cylinder 114, such that the refrigerant passes through the baffle 63.

As described above, because the plunger 116 has a conical lower end portion 117 and a cylindrical body, when the plunger 116 is moved by a pressure difference of the refrigerant, the plunger 116 is easy to balance, and twisting, jamming, or the like does not occur.

The refrigerant flow rate adjusting member 120 is disposed on one end of the communicating pipe 101 and may have a hollow cylindrical shape communicating with the communicating pipe 101. That is, the refrigerant flow rate adjusting member 120 may be implemented by a hollow refrigerant pipe 120, similarly to the communicating pipe 101. The refrigerant flow rate adjusting member 120 may have the same diameter as that of the communicating pipe 101 and may be formed integrally with the communicating pipe 101. Refrigerant passages 123 through which the refrigerant may pass may be formed in a side surface of the refrigerant flow rate adjusting member 120 to adjust a flow rate of the refrigerant introduced into or discharged from the communicating pipe 101. Further, a refrigerant blocking plate 65 preventing the refrigerant from passing between an outer circumferential surface of the refrigerant flow rate adjusting member 120 and the header 50 may be disposed between one end of the refrigerant flow rate adjusting member 120 of the first refrigerant flow control device 100, and the header 50.

A plurality of though-holes 123 may be formed in the outer circumferential surface of the refrigerant pipe 120 as illustrated in FIG. 7 to form the refrigerant passages 123 through which the refrigerant may pass in the side surface of the refrigerant flow rate adjusting member 120. In other words, the refrigerant passages 123 may be implemented as the plurality of through-holes 123 formed in the outer circumferential surface of the refrigerant pipe 120. Here, the further away from the check valve 110, the larger the area of the plurality of through-holes 123 of the refrigerant pipe 120 is. A resistance applied to the refrigerant introduced into or discharged from a hollow 121 of the refrigerant flow rate adjusting member 120 through the refrigerant passages 123 of the side surface of the refrigerant flow rate adjusting member 120 may be adjusted by adjusting a size and the number of the plurality of through-holes 123. Therefore, a resistance applied to the refrigerant flowing into the plurality of flat heat transfer tubes through the refrigerant flow rate adjusting member 120, and a resistance applied to the refrigerant introduced into the hollow 121 of the refrigerant flow rate adjusting member 120 through the plurality of flat heat transfer tubes may be adjusted by adjusting the size and the number of the plurality of through-holes 123 of the refrigerant flow rate adjusting member 120.

As another example, the refrigerant flow rate adjusting member 120 may be implemented by a porous circular pipe formed of a porous member to form the refrigerant passages 123 through which the refrigerant may pass in the side surface of the refrigerant flow rate adjusting member 120. In the case, the porous member used to form the side surface of the refrigerant flow rate adjusting member 120 becomes the refrigerant passage through which the refrigerant passes. As a result, the refrigerant may flow into or be discharged from the hollow 121 of the refrigerant flow rate adjusting member 120 through the side surface of the refrigerant flow rate adjusting member 120.

A length of the refrigerant flow rate adjusting member 120 may correspond to a header space defined by the baffle 63 described above. Specifically, a length from the baffle 63 to one end of the refrigerant flow rate adjusting member 120 may be determined to allow the one end of the refrigerant flow rate adjusting member 120 to be in contact with a virtual plane 67 extending from the baffle 61 disposed in the opposite header 40. As another example, the length of the refrigerant flow rate adjusting member may be determined to allow one end of the refrigerant flow rate adjusting member is in contact with an upper end or a lower end of the header.

For example, in the embodiment illustrated in FIG. 4, the length of the refrigerant flow rate adjusting member 120 of the first refrigerant flow control device 100 disposed on the third baffle 63 of the second header 50 may be determined to allow one end of the refrigerant flow rate adjusting member 120 to be in contact with the virtual plane 67 extending from the first baffle 61 of the first header 40.

The refrigerant flow control device 100 disposed in the second header 50 has been described above, but the same refrigerant flow control device 200 may be disposed in the first header 40. Hereinafter, if necessary, the refrigerant flow control device disposed in the second header 50 is referred to as the first refrigerant flow control device 100, and the refrigerant flow control device disposed in the first header 40 is referred as the second refrigerant flow control device 200.

A length of a refrigerant flow rate adjusting member 220 of the second refrigerant flow control device 200 disposed on the second baffle 62 of the first header 40 disposed adjacent to the second port pipe 42 may be determined to allow one end of the refrigerant flow rate adjusting member 220 is in contact with an upper end of the first header 40. Here, the refrigerant flow rate adjusting member 220 of the second refrigerant flow control device 200 may be directly connected to the second port pipe 42. Therefore, the refrigerant introduced through the second port pipe 42 flows into the upper space 40-3 of the first header 40 through the refrigerant flow rate adjusting member 220 of the second refrigerant flow control device 200.

The refrigerant flow control devices 100 and 200 described above may be disposed in the headers 40 and 50, respectively, by using various methods. For example, in the case where the header has one tube shape, the refrigerant flow control device may be inserted into the header through an opened upper end or lower end of the header and disposed in the header. As another example, in the case where the header is formed by assembling two press-formed header plates, the refrigerant flow control device may be disposed in the header by fixing the refrigerant flow control device to one header plate and assembling the other header plate with the one header plate.

In the case where the refrigerant flow control device is disposed in a space in the header, leakage of the refrigerant to the outside rarely occurs and a separate space for mounting the refrigerant flow control device is not required, such that it is possible to implement an efficient use of an installation space. Further, in the heat exchanger according to the embodiment of the disclosure, the refrigerant flow control device is formed to have a pipe shape, such that it is possible to stably control the refrigerant flow.

Hereinafter, the case where the heat exchanger for an air conditioner according to the embodiment of the disclosure is used as a condenser and an evaporator will be described in detail with reference to FIGS. 11 and 12.

Figure 11:
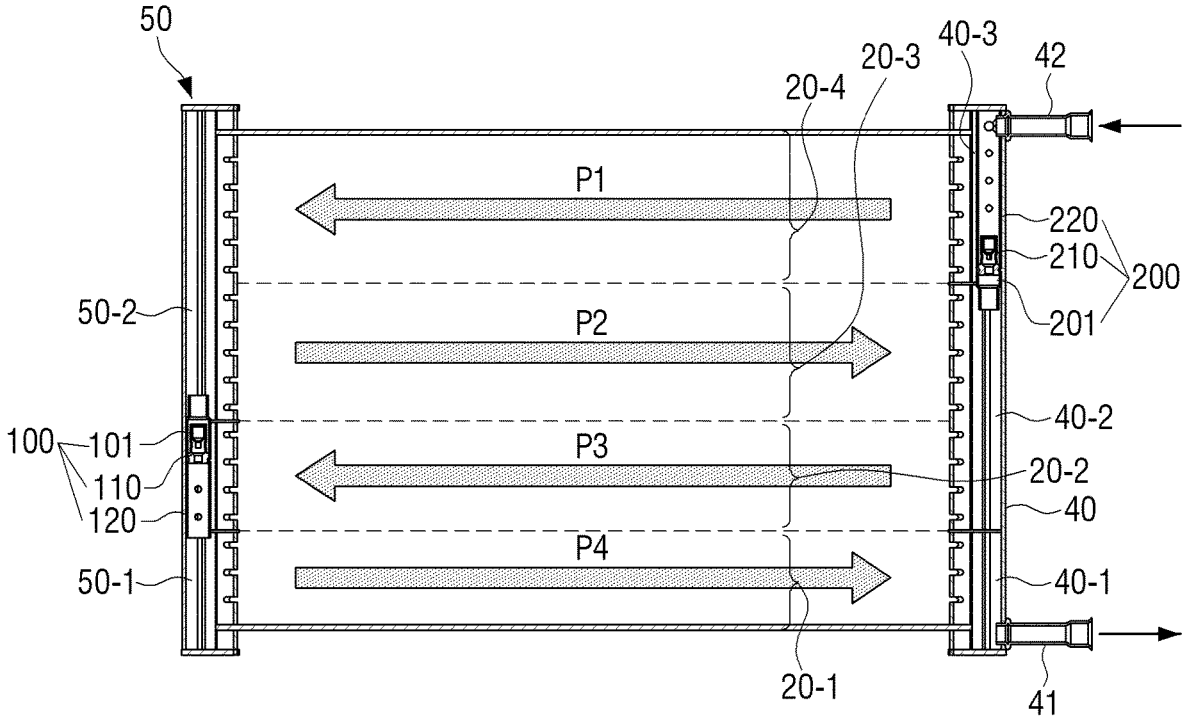
FIG. 11 is a view illustrating the case where the heat exchanger for an air conditioner according to the embodiment of the disclosure is used as a condenser.
Figure 12:
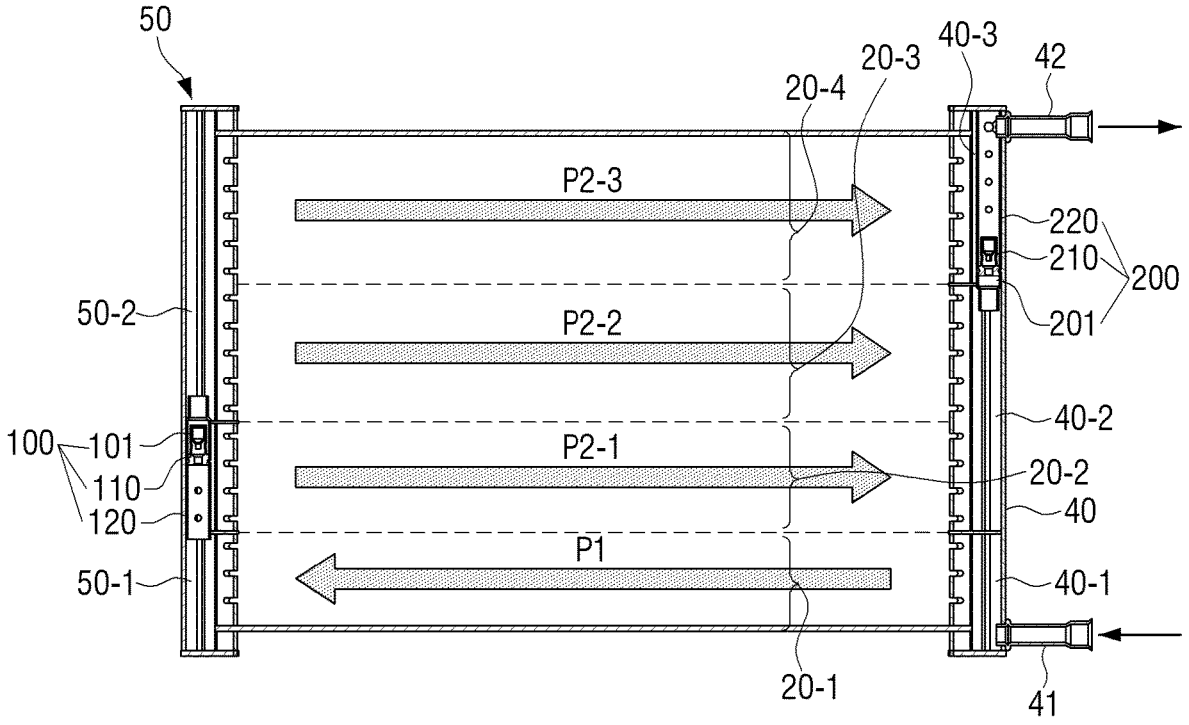
FIG. 12 is a view illustrating the case where the heat exchanger for an air conditioner according to the embodiment of the disclosure is used as an evaporator.

FIG. 11 is a view illustrating the case where the heat exchanger for an air conditioner according to the embodiment of the disclosure is used as a condenser, and FIG. 12 is a view illustrating the case where the heat exchanger for an air conditioner according to the embodiment of the disclosure is used as an evaporator. Note that the plurality of flat heat transfer tubes other than the uppermost and lowermost flat heat transfer tubes 20 are omitted in FIGS. 11 and 12 for convenience of illustration.

In the case where the air conditioner is used as a cooler, the refrigerant is introduced at an upper portion of the first header 40 of the heat exchanger 10 and is discharged at a lower portion of the first header 40. That is, the refrigerant is introduced through the second port pipe 42 of the first header 40 and discharged through the first port pipe 41 of the first header 40.

Specifically, referring to FIG. 11, the refrigerant is introduced into the upper space 40-3 of the first header 40 through the second port pipe 42. Here, the second refrigerant flow control device 200 is disposed in the upper space 40-3 of the first header 40, and thus the refrigerant introduced through the second port pipe 42 flows into the upper space 40-3 of the first header 40 through a plurality of refrigerant passages formed in a side surface of the refrigerant flow rate adjusting member 220.

In the case where the refrigerant is introduced through the second port pipe 42, a pressure of the refrigerant in the upper space 40-3 of the first header 40 is higher than a pressure of the refrigerant in the middle space 40-2 of the first header 40. Therefore, a check valve 210 of the second refrigerant flow control device 200 is not opened, such that the refrigerant may not flow to the middle space 40-2 through the second refrigerant flow control device 200. Specifically, a plunger 216 (see FIG. 6) of the check valve 210 of the second refrigerant flow control device 200 closes a conical hole 213 of a valve seat 211 and a plurality of refrigerant holes 215 of a cylinder 214 by the pressure of the refrigerant, and thus the refrigerant does not flow to the middle space 40-2 through a through-hole 212 of the valve seat 211.

Therefore, the refrigerant introduced into the upper space 40-3 of the first header 40 through the second port pipe 42 flows into the upper space 50-2 of the second header 50 through the fourth flat heat transfer tube group 20-4 corresponding to the upper space 40-3 (P1).

The first refrigerant flow control device 100 is disposed on the third baffle 63 partitioning the second header 50 into the upper space 50-2 and the lower space 50-1. Here, a pressure of the refrigerant in the upper space 50-2 of the second header 50 is higher than a pressure of the refrigerant in the lower space 50-1 of the second header 50, and thus the check valve 110 of the first refrigerant flow control device 100 is not opened. As a result, the refrigerant may not flow to the lower space 50-1 of the second header 50 through the first refrigerant flow control device 100 disposed on the third baffle 63. Specifically, the plunger 116 of the check valve 110 of the first refrigerant flow control device 100 closes the conical hole 113 of the valve seat 111 and the plurality of refrigerant holes 115 of the cylinder 114 by the pressure of the refrigerant, and thus the refrigerant does not flow to the lower space 50-1 of the second header 50 through the through-hole 112 of the valve seat 111.

As a result, the refrigerant introduced into the upper space 50-2 of the second header 50 through the fourth flat heat transfer tube group 20-4 flows into the middle space 40-2 of the first header 40 through the third flat heat transfer tube group 20-3 corresponding a region between the third baffle 63 of the second header 50 and the second baffle 62 of the first header 40 (P2).

A lower end of the middle space 40-2 of the first header 40 is blocked by the first baffle 61, and thus the refrigerant introduced into the middle space 40-2 of the first header 40 is introduced into the lower space 50-1 of the second header 50 through the second flat heat transfer tube group 20-2 corresponding to a region between the first baffle 61 of the first header 40 and the third baffle 63 of the second header 50 (P3). Here, the refrigerant flow rate adjusting member 120 of the first refrigerant flow control device 100 is disposed in the lower space 50-1 of the second header 50, and thus the refrigerant is introduced into the hollow 121 through the refrigerant passages 123 of the side surface of the refrigerant flow rate adjusting member 120.

The check valve 110 of the first refrigerant flow control device 100 disposed in the lower space 50-1 of the second header 50 is in a closed state, and thus the refrigerant introduced into the lower space 50-1 of the second header 50 may not flow to the upper space 50-2 of the second header 50. As a result, the refrigerant introduced into the lower space 50-1 of the second header 50 through the second flat heat transfer tube group 20-2 flows into the lower space 40-1 of the first header 40 through the first flat heat transfer tube group 20-1 corresponding a region between the lower end of the second header 50 and the first baffle 61 of the first header 40 (P4).

The refrigerant introduced into the lower space 40-1 of the first header 40 is discharged to the outside of the heat exchanger 10 through the first port pipe 41.

As described above, in the case where the heat exchanger 10 according to the embodiment of the disclosure functions as a condenser, the number of turns of the moving path of the refrigerant is four turns (P1, P2, P3, and P4).

In the case where the air conditioner is used as a heater, the refrigerant is introduced at the lower portion of the first header 40 of the heat exchanger 10 and is discharged at the upper portion of the first header 40. That is, the refrigerant is introduced through the first port pipe 41 of the first header 40 and discharged through the second port pipe 42 of the first header 40.

Specifically, referring to FIG. 12, the refrigerant is introduced into the lower space 40-1 of the first header 40 through the first port pipe 41. Here, the first baffle 61 is disposed at an upper end of the lower space 40-1 of the first header 40, and thus the refrigerant introduced through the first port pipe 41 may not pass through the first baffle 61 and is introduced into the lower space 50-1 of the second header 50 through the first flat heat transfer tube group 20-1 corresponding to the region between the first baffle 61 of the first header 40 and the lower end of the second header 50 (P1).

The first refrigerant flow control device 100 is disposed on the third baffle 63 of the second header 50. Here, a pressure of the refrigerant in the lower space 50-1 of the second header 50 is higher than a pressure of the refrigerant in the upper space 50-2 of the second header 50, and thus the check valve 110 of the first refrigerant flow control device 100 is opened. As a result, the refrigerant flows to the upper space 50-2 of the second header 50 through the check valve 110 of the first refrigerant flow control device 100. Specifically, the plunger 116 of the check valve 110 of the first refrigerant flow control device 100 becomes away from the conical hole 113 of the valve seat 111 by the pressure of the refrigerant to open the plurality of refrigerant holes 115 of the cylinder 114, and thus the refrigerant flows to the upper space 50-2 of the second header 50 through the through-hole 112 of the valve seat 111 and the plurality of refrigerant holes 115 of the cylinder 114.

Therefore, the refrigerant introduced into the lower space 50-1 of the second header 50 flows in two paths. That is, a part of the refrigerant introduced into the lower space 50-1 of the second header 50 flows to the middle space 40-2 of the first header 40 through the second flat heat transfer tube group 20-2 corresponding to the region between the first baffle 61 and the third baffle 63 and through the refrigerant passages 123 of the side surface of the refrigerant flow rate adjusting member 120 of the first refrigerant flow control device 100 (P2-1). Meanwhile, the remaining part of the refrigerant introduced into the lower space 50-1 of the second header 50 is introduced into the upper space 50-2 of the second header 50 through the first refrigerant flow control device 100 with the opened check valve 110 as described above.

The refrigerant introduced into the upper space 50-2 of the second header 50 through the first refrigerant flow control device 100 flows to the first header 40 through the third flat heat transfer tube group 20-3 and the fourth flat heat transfer tube group 20-4 corresponding to the upper space 50-2 of the second header 50. Specifically, a part of the refrigerant in the upper space 50-2 of the second header 50 is introduced into the middle space 40-2 of the first header 40 through the third flat heat transfer tube group 20-3 (P2-2), and the remaining part of the refrigerant in the upper space 50-2 of the second header 50 is introduced into the upper space 40-3 of the first header 40 through the fourth flat heat transfer tube group 20-4 (P2-3).

In the case where the refrigerant is introduced through the first port pipe 41 and flows upward in the first header 40, a pressure of the refrigerant in the upper space 40-3 of the first header 40 is lower than a pressure of the refrigerant in the middle space 40-2 of the first header 40. Therefore, the check valve 210 of the second refrigerant flow control device 200 is opened, such that the refrigerant may flow to the upper space 40-3 through the check valve 210 of the second refrigerant flow control device 200. Specifically, the plunger 216 of the check valve 210 of the second refrigerant flow control device 200 becomes away from the conical hole 213 of the valve seat 211 by the pressure of the refrigerant to open the plurality of refrigerant holes 215 of the cylinder 214, and thus the refrigerant flows to the hollow 221 of the refrigerant flow rate adjusting member 220 disposed on an upper end of the check valve 210 through the through-hole 212 of the valve seat 211 and the plurality of refrigerant holes 215 of the cylinder 214.

Here, the second port pipe 42 is directly connected to the refrigerant flow rate adjusting member 220 of the second refrigerant flow control device 200, and thus the refrigerant introduced into the middle space 40-2 of the first header 40 is discharged to the second port pipe 42 through the check valve 210 of the second refrigerant flow control device 200 disposed on the second baffle 62, and the refrigerant flow rate adjusting member 220.

Meanwhile, the refrigerant introduced into the upper space 40-3 of the first header 40 through the fourth flat heat transfer tube group 20-4 is introduced into the hollow 221 through the refrigerant passages 223 of the side surface of the refrigerant flow rate adjusting member 220 of the second refrigerant flow control device 200 disposed in the upper space 40-3, and is discharged to the second port pipe 42.

As described above, in the case where the heat exchanger 10 according to the embodiment of the disclosure functions as an evaporator, the number of turns of the moving path of the refrigerant is two turns (P1 and P2 (P2-1, P2-2, and P2-3)). Therefore, in the heat exchanger 10 according to the embodiment of the disclosure, the number of turns in the case where the heat exchanger 10 is used as a condenser and the number of turns in the case where the heat exchanger 10 is used as an evaporator may be different from each other. Accordingly, an appropriate mass flow rate and a flow length may be achieved under each condition. As a result, it is possible to significantly reduce a pressure loss of the heat exchanger 10 to improve heat transfer performance.

In addition, the heat exchanger 10 according to the embodiment of the disclosure further includes the refrigerant flow rate adjusting member 120 and 220 for adjusting a deviation of the refrigerant flow depending on the path in the case where the heat exchanger 10 is used as an evaporator, such that it is possible to lessen evaporation performance deterioration due to the deviation of the refrigerant flow.

Hereinafter, a resistance of each refrigerant moving path in the heat exchanger depending on a presence or absence of the refrigerant flow rate adjusting member in the case where the heat exchanger according to the embodiment of the disclosure functions as an evaporator will be described with reference to FIGS. 13 and 14.

Figure 13:
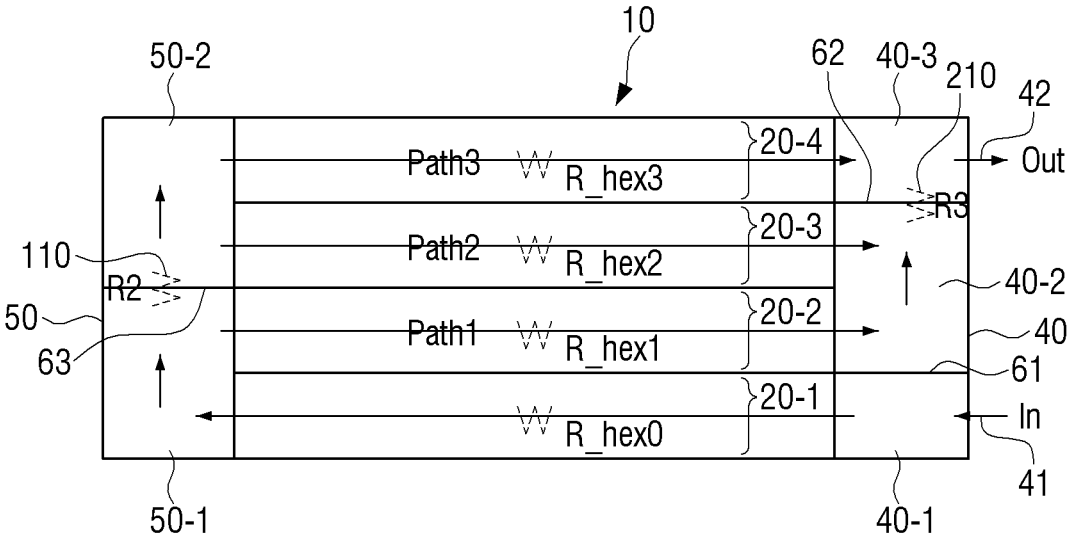
FIG. 13 is a conceptual view for describing a resistance of a refrigerant moving path in the case where the heat exchanger for an air conditioner according to the embodiment of the disclosure that does not include the refrigerant flow rate adjusting member is used as an evaporator.
Figure 14:
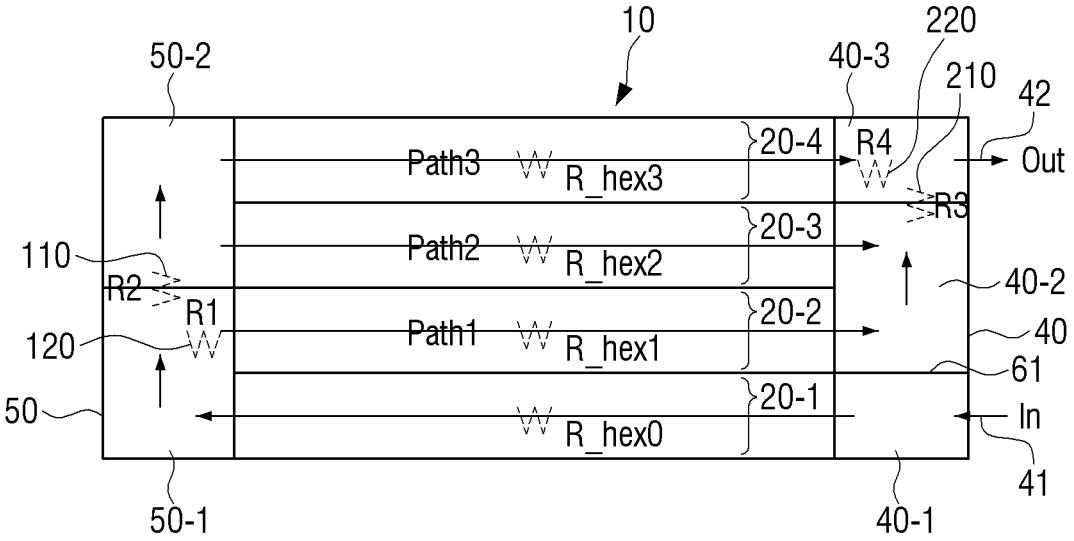
FIG. 14 is a conceptual view for describing a resistance of a refrigerant moving path in the case where the heat exchanger for an air conditioner according to the embodiment of the disclosure that includes the refrigerant flow rate adjusting member is used as an evaporator.

FIG. 13 is a conceptual view for describing a resistance applied to a refrigerant moving path in the case where the heat exchanger for an air conditioner according to the embodiment of the disclosure that does not include the refrigerant flow rate adjusting member is used as an evaporator, and FIG. 14 is a conceptual view for describing a resistance applied to a refrigerant moving path in the case where the heat exchanger for an air conditioner according to the embodiment of the disclosure that includes the refrigerant flow rate adjusting member is used as an evaporator.

Referring to FIG. 13, in the heat exchanger 10 functioning as an evaporator, the refrigerant is introduced into the lower space 40-1 of the first header 40 through the first port pipe 41 disposed at the lower portion of the first header 40 and is introduced into the lower space 50-1 of the second header through the first flat heat transfer tube group 20-1. Here, the first baffle 61 is disposed at the upper end of the lower space 40-1 of the first header 40, and thus the refrigerant does not flow upward.

The refrigerant introduced into the lower space 50-1 of the second header 50 moves to the first header 40 through three moving paths as described below.

A part of the refrigerant introduced into the lower space 50-1 of the second header 50 moves to the middle space 40-2 of the first header 40 through the second flat heat transfer tube group 20-2 (first moving path) (Path1). Meanwhile, the remaining part of the refrigerant in the lower space 50-1 of the second header 50 is introduced into the upper space 50-2 of the second header 50 through the check valve 110 of the first refrigerant flow control device 100 disposed on the third baffle 63.

A part of the refrigerant introduced into the upper space 50-2 of the second header 50 is introduced into the middle space 40-2 of the first header 40 through the third flat heat transfer tube group 20-3 (second moving path) (Path2). Further, the remaining part of the refrigerant introduced into the upper space 50-2 of the second header 50 moves to the upper space 40-3 of the first header 40 through the fourth flat heat transfer tube group 20-4 (third moving path) (Path3).

The refrigerant introduced into the middle space 40-2 of the first header 40 through the second flat heat transfer tube group 20-2 and the third flat heat transfer tube group 20-3 is introduced into the upper space 40-3 of the first header 40 through the check valve 210 of the second refrigerant flow control device 200 disposed on the second baffle 62 of the first header 40.

The refrigerant introduced into the upper space 40-3 of the first header 40 through the fourth flat heat transfer tube group 20-4 and the check valve 210 of the second refrigerant flow control device 200 is discharged to the outside of the heat exchanger 10 through the second port pipe 42.

In the case where the refrigerant in the second header 50 moves to the upper space 40-3 of the first header 40 through the above-described three moving paths, a resistance applied to the refrigerant moving through each moving path may be represented as follows.

$$R\text{-Path1}=R_\text{hex0}+R_\text{hex_1}+R3$$

$$R\text{-Path2}=R_\text{hex0}+R2+R_\text{hex2}+R3$$

$$R\text{-Path3}=R_\text{hex0}+R2+R_\text{hex3}$$

Here, R-Path1 represents a resistance applied to the refrigerant moving through the first moving path, R-Path2 represents a resistance applied to the refrigerant moving through the second moving path, R-Path3 represents a resistance applied to the refrigerant moving through the third moving path, R_hex0 represents a resistance applied to the refrigerant moving from the first header to the second header through the first flat heat transfer tube group, R_hex1 represents a resistance applied to the refrigerant moving from the second header to the first header through the second flat heat transfer tube group, R_hex2 represents a resistance applied to the refrigerant moving from the second header to the first header through the third flat heat transfer tube group, R_hex3 represents a resistance applied to the refrigerant moving from the second header to the first header through the fourth flat heat transfer tube group, R2 represents a resistance applied to the refrigerant at the time of passing through the first refrigerant flow control device, and R3 represents a resistance applied to the refrigerant at the time of passing through the second refrigerant flow control device.

The second, third and fourth flat heat transfer tube groups have structures similar to each other or same as each other, and thus R_hex1, R_hex2, and R_hex3 are substantially the same as one another. Further, the first refrigerant flow control device and the second refrigerant flow control device also have structures similar to each other or same as each other, and thus R2 and R3 are substantially the same as each other. Accordingly, R-Path1, R-Path2, and R-Path3 have the following relationship.

$$R\text{-Path2} > R\text{-Path1} \approx R\text{-Path3}$$

As can be appreciated from the above expression, a resistance of the second moving path is higher than a resistance of the third moving path and a resistance of the first moving path, and the resistance of the third moving path and the resistance of the first moving path are similar to each other. In the case where the resistances of the three moving paths are different from one another as described above, an amount of refrigerant moving through the second moving path is decreased because the refrigerant tends to move to a path with a lower resistance. Therefore, a flow of the refrigerant moving through the three moving paths is not uniform and the deviation of the refrigerant flow is generated, which is problematic.

Referring to FIG. 14, in the heat exchanger 10 functioning as an evaporator, the refrigerant is introduced into the lower space 40-1 of the first header 40 through the first port pipe 41 disposed at the lower portion of the first header 40 and is introduced into the lower space 50-1 of the second header 50 through the first flat heat transfer tube group 20-1. Here, the first baffle 61 is disposed at the upper end of the lower space 40-1 of the first header 40, and thus the refrigerant does not flow upward.

The refrigerant introduced into the lower space 50-1 of the second header 50 moves to the upper space 40-3 of the first header 40 through three moving paths as described below.

A part of the refrigerant introduced into the lower space 50-1 of the second header 50 is introduced into the second flat heat transfer tube group 20-2 through the refrigerant passages 223 of the side surface of the refrigerant flow rate adjusting member 220 of the second refrigerant flow control device 200 disposed on the third baffle 63, and moves to the middle space 40-2 of the first header 40 through the second flat heat transfer tube group 20-2 (first moving path). Meanwhile, the remaining part of the refrigerant in the lower space 50-2 of the second header 50 is introduced into the upper space 50-2 of the second header 50 through the check valve 110 of the first refrigerant flow control device 100 disposed on the third baffle 63.

A part of the refrigerant introduced into the upper space 50-2 of the second header 50 is introduced into the middle space 40-2 of the first header 40 through the third flat heat transfer tube group 20-3 (second moving path) (Path2). Further, the remaining part of the refrigerant introduced into the upper space 50-2 of the second header 50 moves to the upper space 40-3 of the first header 40 through the fourth flat heat transfer tube group 20-4, is introduced into the hollow 221 of the refrigerant flow rate adjusting member 220 through the refrigerant passages 223 of the side surface of the refrigerant flow rate adjusting member 220 of the second refrigerant flow control device 200 disposed on the second baffle 62 of the first header 40, and then is discharged to the second port pipe 42 (third moving path).

The refrigerant introduced into the middle space 40-2 of the first header 40 through the second flat heat transfer tube group 20-2 and the third flat heat transfer tube group 20-3 is discharged to the second port pipe 42 through the check valve 210 of the second refrigerant flow control device 200 and the hollow 221 of the refrigerant flow rate adjusting member 220.

Therefore, in the case where the refrigerant in the second header 50 is discharged to the second port pipe 42 of the first header 40 through the above-described three moving paths, a resistance applied to the refrigerant moving through each moving path may be represented as follows.

$$R\text{-Path1} = R_\text{hex0} + R1 + R_\text{hex1} + R3$$

$$R\text{-Path2} = R_\text{hex0} + R2 + R_\text{hex2} + R3$$

$$R\text{-Path3} = R_\text{hex0} + R2 + R_\text{hex3} + R4$$

Here, R-Path1 represents a resistance applied to the refrigerant moving through the first moving path, R-Path2 represents a resistance applied to the refrigerant moving through the second moving path, R-Path3 represents a resistance applied to the refrigerant moving through the third moving path, R-hex0 represents a resistance applied to the refrigerant moving from the first header to the second header through the first flat heat transfer tube group, R-hex1 represents a resistance applied to the refrigerant moving from the second header to the first header through the second flat heat transfer tube group, R-hex2 represents a resistance applied to the refrigerant moving from the second header to the first header through the third flat heat transfer tube group, R-hex3 represents a resistance applied to the refrigerant moving from the second header to the first header through the fourth flat heat transfer tube group, R1 represents a resistance applied to the refrigerant at the time of passing through the refrigerant passages of the side surface of the refrigerant flow rate adjusting member of the first refrigerant flow control device, R2 represents a resistance applied to the refrigerant at the time of passing through the check valve of the first refrigerant flow control device, R3 represents a resistance applied to the refrigerant at the time of passing through the check valve of the second refrigerant flow control device, and R4 represents a resistance applied to the refrigerant at the time of passing through the refrigerant passages of the side surface of the refrigerant flow rate adjusting member of the second refrigerant flow control device.

The second, third and fourth flat heat transfer tube groups 20-2, 20-3, and 20-4 have structures similar to each other or same as each other, and thus R_hex1, R_hex2, and R_hex3 are substantially the same as one another. Further, the first refrigerant flow control device and the second refrigerant flow control device also have structures similar to each other or same as each other, and thus R2 and R3 are substantially the same as each other. Accordingly, in the case where R1 and R2 are similar to each other and R4 and R3 are similar to each other, R-Path1, R-Path2, and R-Path3 may have the following relationship.

$$R\text{-Path1} \approx R\text{-Path2} \approx R\text{-Path3}$$

That is, in the heat exchanger according to the embodiment of the disclosure, the resistances applied to the refrigerant moving through the three moving paths may become substantially uniform by adjusting the resistance of the refrigerant passages of the refrigerant flow rate adjusting member of the refrigerant flow control devices. As such, in the case where the resistances applied to the refrigerant moving through the three moving paths, that is, the first moving path, the second moving path, and the third moving path, are similar to each other or the same as each other, the refrigerant flow may become substantially uniform.

Although the case where the heat exchanger 10 according to the embodiment of the disclosure is constituted by one row of heat exchanger has been described above, the heat exchanger may also be constituted by two or more rows of heat exchangers.

Hereinafter, the case where the heat exchanger according to the embodiment of the disclosure is constituted by two rows of heat exchangers will be described in detail with reference to FIGS. 15 and 16.

Figure 15:
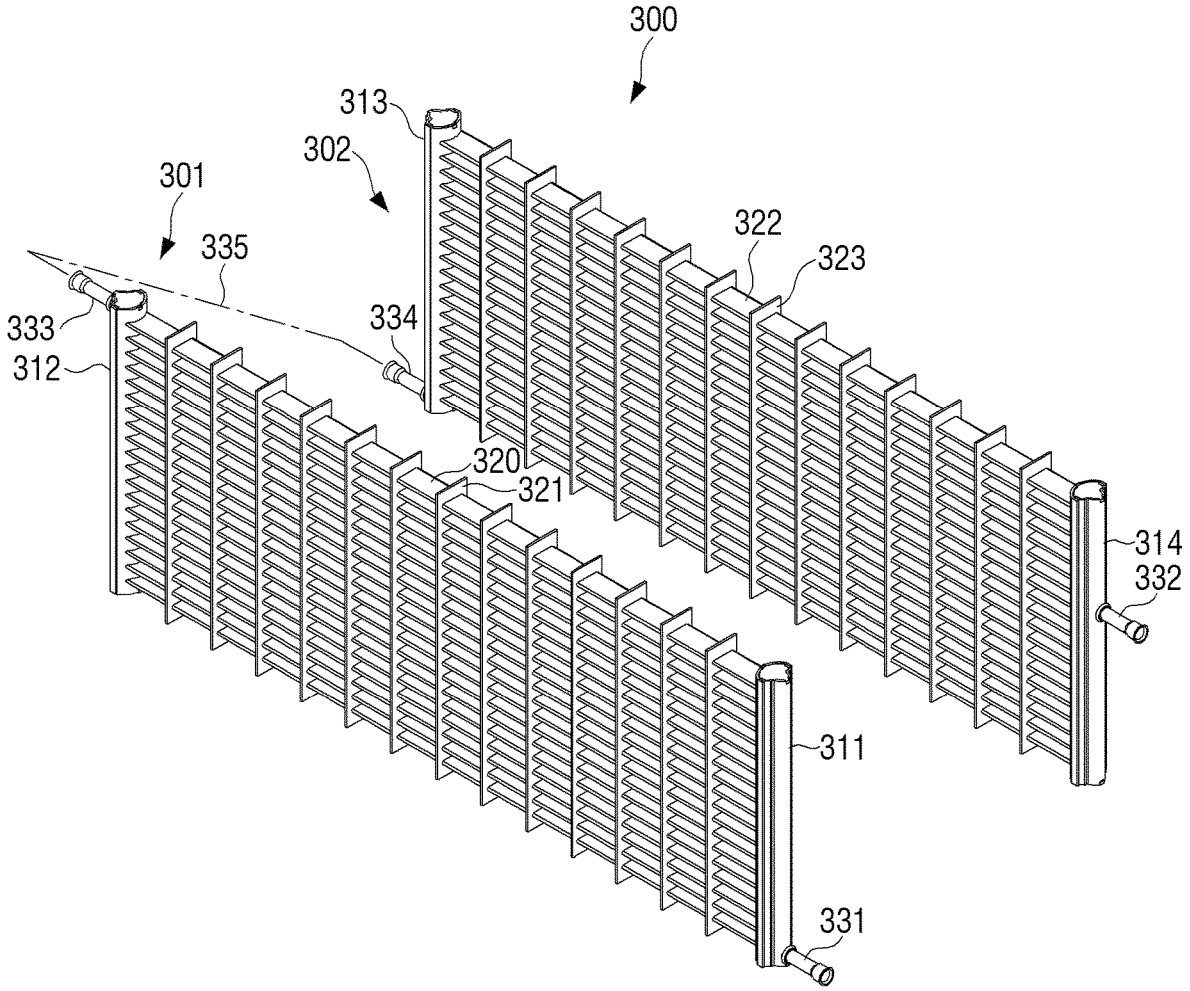
FIG. 15 is a perspective view illustrating a heat exchanger for an air conditioner according to another embodiment of the disclosure.
Figure 16:
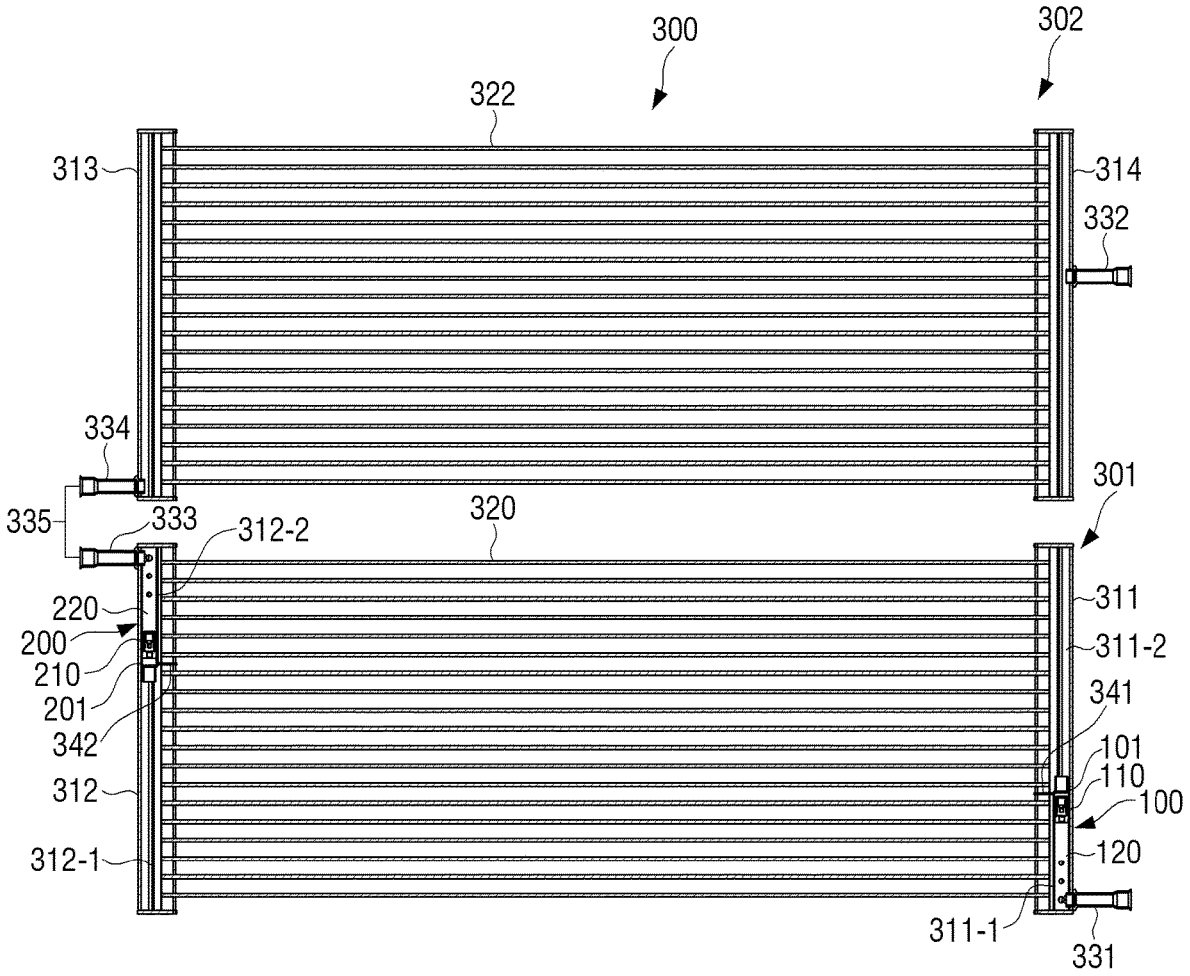
FIG. 16 is a cross-sectional view of the heat exchanger for an air conditioner of FIG. 15.

FIG. 15 is a perspective view illustrating a heat exchanger for an air conditioner according to another embodiment of the disclosure, and FIG. 16 is a cross-sectional view of the heat exchanger for an air conditioner of FIG. 15. Note that a first-row heat exchanger and a second-row heat exchanger are vertically arranged in FIG. 16 for convenience of illustration.

Referring to FIGS. 15 and 16, a heat exchanger 300 for an air conditioner according to an embodiment of the disclosure may include a first-row heat exchanger 301 and a second-row heat exchanger 302. Although FIGS. 15 and 16 illustrate a state in which the first-row heat exchanger 301 and the second-row heat exchanger 302 are spaced apart from each other, this is for convenience of illustration, and the first-row heat exchanger 301 and the second-row heat exchanger 302 are disposed to overlap each other and be adjacent to each other.

The first-row heat exchanger 301 may include a plurality of flat heat transfer tubes 320, a plurality of fins 321, a first header 311, and a second header 312.

The plurality of flat heat transfer tubes 320, which are tubes in which a refrigerant flows, are disposed parallel to each other in a horizontal direction between the first header 311 and the second header 312. Therefore, the plurality of flat heat transfer tubes 320 are stacked and spaced at predetermined intervals in a vertical direction. Each of the plurality of flat heat transfer tubes 320 may include a flat and substantially rectangular body, and a plurality of ribs partitioning an inner space of the body into a plurality of refrigerant flow paths.

The plurality of fins 321 are arranged at predetermined intervals on outer surfaces of the plurality of flat heat transfer tubes 320. That is, the plurality of fins 321 are disposed perpendicular to the plurality of flat heat transfer tubes 320, between the first header 311 and the second header 312. Note that the fins 321 are omitted in FIG. 16 for convenience of illustration.

The first header 311 is disposed on one ends of the plurality of flat heat transfer tubes 320, and the second header 312 is disposed on the other ends of the plurality of flat heat transfer tubes 320. That is, the second header 312 is spaced apart from the first header 311 by a length of the flat heat transfer tube 320. The first header 311 and the second header 312 each extend to a predetermined length in a vertical direction and each have a hollow tube shape.

An inner space of each of the first header 311 and the second header 312 communicates with the plurality of flat heat transfer tubes 320 to allow the refrigerant to flow. Therefore, the refrigerant in the first header 311 or the second header 312 may flow into the flat heat transfer tubes 320, and the refrigerant passing through the flat heat transfer tubes 320 may flow into the first header 311 or the second header 312.

A first port pipe 331 through which the refrigerant flows into or discharged from the first header 311 may be disposed on the first header 311. The first port pipe 331 may be provided at a lower end portion of the first header 311. A first connection port 333 to which a connecting pipe 335 connecting between the first-row heat exchanger 301 and the second-row heat exchanger 302 is connected may be provided on the second header 312. The first connection port 333 may be provided at an upper end portion of the second header 312.

At least one baffle partitioning an inner space of each header into two or more spaces may be disposed in each of the first header 311 and the second header 312. In the heat exchanger 300 according to the embodiment of the disclosure illustrated in FIG. 16, the first header 311 includes one baffle 341 (first baffle) and the second header 312 includes one baffle 342 (second baffle). The baffle 341 or 342 blocks the inner space of the header 311 or 312 to prevent the refrigerant from passing through the baffle and flowing in the header. The first header 311 is partitioned into two spaces including a lower space 311-1 and an upper space 311-2 by the first baffle 341. The second header 312 is partitioned into two spaces including a lower space 312-1 and an upper space 312-2 by the second baffle 342.

Further, the plurality of flat heat transfer tubes 320 may be partitioned into three flat heat transfer tube groups by the two baffles 341 and 342. Specifically, the plurality of flat heat transfer tubes 320 disposed between a lower end of the first header 311 and the first baffle 341 of the first header 311 are grouped into a first flat heat transfer tube group 320-1, the plurality of flat heat transfer tubes 320 disposed between the first baffle 341 of the first header 311 and the second baffle 342 of the second header 312 are grouped into a second flat heat transfer tube group 320-2, and the plurality of flat heat transfer tubes 320 disposed between the second baffle 342 of the second header 312 and the upper end of the first header 311 are grouped into a third flat heat transfer tube group 320-3. Flow directions of the refrigerant passing through the plurality of flat heat transfer tubes 320 grouped into each flat heat transfer tube group 320-1, 320-2, or 320-3 are the same as each other. For example, the refrigerant passing through the plurality of flat heat transfer tubes 320 grouped into the first flat heat transfer tube group 320-1 flows in the same direction.

A refrigerant flow control device 100 or 200 which allows the refrigerant to selectively pass through the baffle to control a refrigerant flow may be disposed in at least one of the plurality of baffles 341 and 342 disposed in the headers 311 and 312, respectively. The refrigerant flow control devices 100 and 200 block the refrigerant flow to prevent the refrigerant from passing through the refrigerant flow control devices 100 and 200 to function as baffles, in the case where the refrigerant flows in one direction in the headers 311 and 312. The refrigerant flow control devices 100 and 200 are operated to allow the refrigerant to pass through the refrigerant flow control devices 100 and 200 to make the spaces inside the header partitioned by the baffle communicate with each other, in the case where the refrigerant flows in a direction opposite to the one direction in the headers 311 and 312. Further, the refrigerant flow control devices 100 and 200 may perform a function of controlling a flow rate of the refrigerant passing through the refrigerant flow control devices 100 and 200, respectively.

In this embodiment, the first refrigerant flow control device 100 is disposed on the first baffle 341 of the first header 311, and the second refrigerant flow control device 200 is disposed on the second baffle 342 of the second header 312 as illustrates in FIG. 16. The first and second refrigerant flow control devices 100 and 200 are different from the refrigerant flow control devices 100 and 200 according to the embodiment described above only in regard to a disposing position, and structures thereof are the same as or similar to those of the refrigerant flow control devices 100 and 200 according to the embodiment described above. Therefore, a detailed description thereof will be omitted.

One end of a refrigerant flow rate adjusting member 120 of the first refrigerant flow control device 100 disposed on the first baffle 341 of the first header 311 is in contact with the lower end of the first header 311 and communicates with the first port pipe 331. Therefore, the refrigerant introduced through the first port pipe 331 flows into the lower space 311-1 of the first header 311 through refrigerant passages 123 (see FIG. 7) of a side surface of the refrigerant flow rate adjusting member 120 of the first refrigerant flow control device 100, or introduced into the upper space 311-2 of the first header 311 through a check valve 110. Further, the refrigerant introduced into the lower space 311-1 of the first header 311 through the first flat heat transfer tube group 320-1 from the lower space 312-1 of the second header 312 is discharged to the first port pipe 331 through the refrigerant passages 123 of the side surface of the refrigerant flow rate adjusting member 120 of the first refrigerant flow control device 100.

One end of a refrigerant flow rate adjusting member 220 of the second refrigerant flow control device 200 disposed on the second baffle 342 of the second header 312 is in contact with an upper end of the second header 312 and communicates with the first connection port 333. Therefore, the refrigerant introduced into the first connection port 333 is introduced into the upper space 312-2 of the second header 312 through refrigerant passages 223 (see FIG. 6) of a side surface of the refrigerant flow rate adjusting member 220 of the second refrigerant flow control device 200. Further, the refrigerant introduced into the upper space 312-2 of the second header 312 through the third flat heat transfer tube group 320-3 from the upper space 311-2 of the first header 311 is discharged to the first connection port 333 through the refrigerant passages 223 of the side surface of the refrigerant flow rate adjusting member 220 of the second refrigerant flow control device 200. Meanwhile, the refrigerant introduced from the lower space 312-1 of the second header 312 through a check valve 210 of the second refrigerant flow control device 200 is discharged to the first connection port 333 through a hollow 221 of the refrigerant flow rate adjusting member 220.

The second-row heat exchanger 302 may include a plurality of flat heat transfer tubes 322, a plurality of fins 323, a third header 313, and a fourth header 314.

The plurality of flat heat transfer tubes 322 are disposed parallel to the plurality of flat heat transfer tubes 320, and the third header 313 and the fourth header 314 are disposed on opposite ends of the plurality of flat heat transfer tubes 322. The plurality of fins 323 are disposed between the third header 313 and the fourth header 314. The plurality of flat heat transfer tubes 322 and the fins 323 are the same as or similar to the plurality of flat heat transfer tubes 320 and the fins 321 of the first-row heat exchanger 301 described above, and thus a detailed description thereof will be omitted.

The third header 313 is disposed on one ends of the plurality of flat heat transfer tubes 322, and the fourth header 314 is disposed on the other ends of the plurality of flat heat transfer tubes 322. That is, the fourth header 314 is spaced apart from the third header 313 by a length of the flat heat transfer tube 322. The third header 313 and the fourth header 314 each extend to a predetermined length in a vertical direction and each have a hollow tube shape.

An inner space of each of the third header 313 and the fourth header 314 communicates with the plurality of flat heat transfer tubes 322 to allow the refrigerant to flow. Therefore, the refrigerant in the third header 313 or the fourth header 314 may flow into the plurality of flat heat transfer tubes 322, and the refrigerant passing through the plurality of flat heat transfer tubes 322 may flow into the third header 313 or the fourth header 314.

A second connection port 334 through which the refrigerant flows into or discharged from the third header 313 may be disposed on the third header 313. The second connection port 334 may be disposed at a lower end portion of the third header 313 and communicate with the first connection port 333 of the second header 312 through the connecting pipe 335. That is, the upper end portion of the second header 312 and the lower end portion of the third header 313 are connected to each other through the connecting pipe 335. Therefore, the first-row heat exchanger 301 and the second-row heat exchanger 302 are connected to each other through the first connection port 333, the second connection port 334, and the connecting pipe 335. Further, a second port pipe 332 through which the refrigerant flows in and out may be provided at an upper end of the fourth header 314.

The third header 313 and the fourth header 314 having the above-described structure are similar to the first header 311 and the second header 312 described above, but are different from the first header 311 and the second header 312 in that the baffles 341 and 342 are not disposed in the third header 313 and the fourth header 314.

Hereinafter, the case where the heat exchanger 300 having the two-row structure according to the embodiment of the disclosure described above functions as a condenser and an evaporator will be described in detail with reference to FIGS. 17 and 18.

Figure 17:
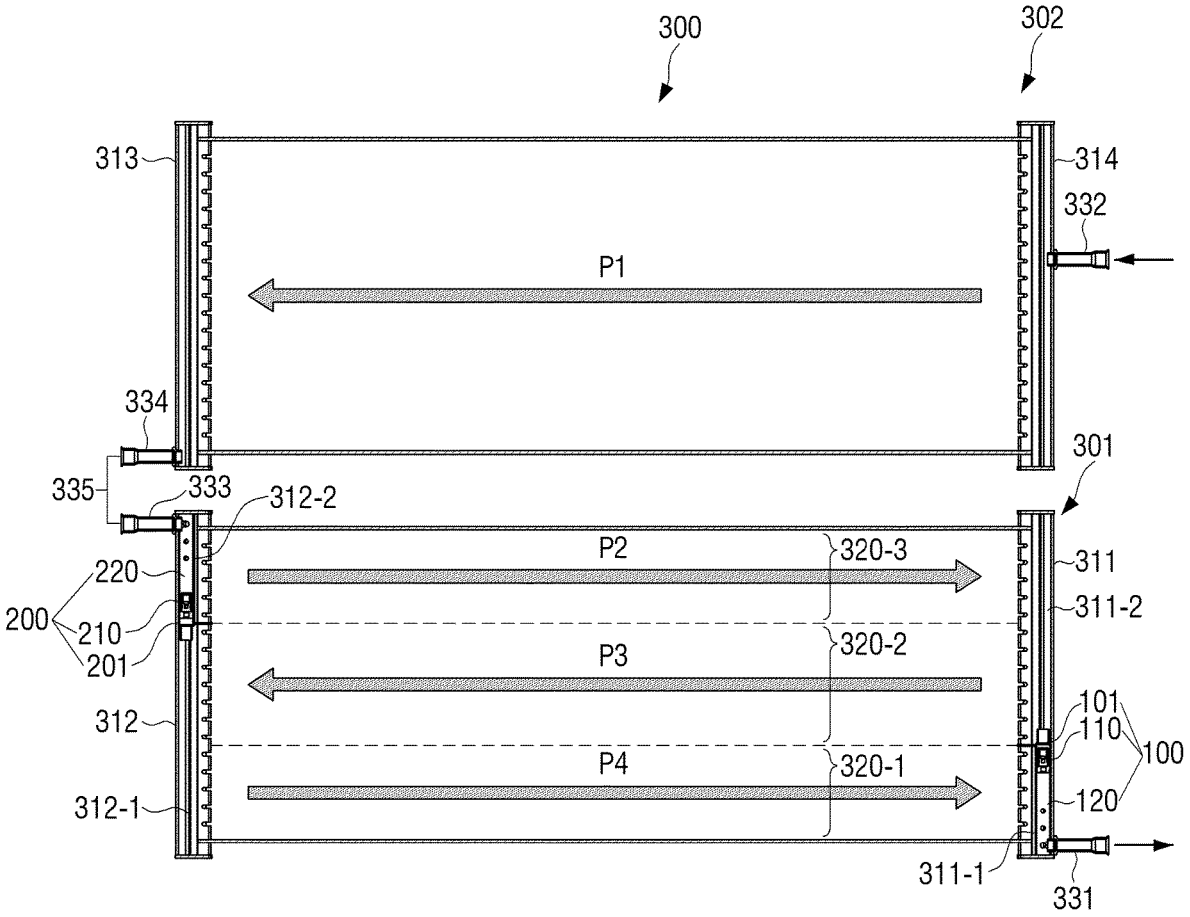
FIG. 17 is a view illustrating the case where the heat exchanger for an air conditioner of FIG. 15 is used as a condenser.

FIG. 17 is a view illustrating the case where the heat exchanger for an air conditioner of FIG. 15 is used as a condenser. FIG. 18 is a view illustrating the case where the heat exchanger for an air conditioner of FIG. 15 is used as an evaporator. However, the plurality of flat heat transfer tubes other than the uppermost and lowermost flat heat transfer tubes are omitted in FIGS. 17 and 18 for convenience of illustration and explanation.

In the case where the air conditioner is used as a cooler, the refrigerant is introduced at an upper portion of the fourth header 314 of the second-row heat exchanger 302 and is discharged at a lower portion of the first header 311 of the first-row heat exchanger 301. That is, the refrigerant is introduced through the second port pipe 332 of the fourth header 314 of the second-row heat exchanger 302 and discharged through the first port pipe 331 of the first header 311 of the first-row heat exchanger 301.

Specifically, referring to FIG. 17, the refrigerant is introduced into an inner space of the fourth header 314 through the second port pipe 332 of the fourth header 314 of the second-row heat exchanger 302. The refrigerant introduced into the inner space of the fourth header 314 is introduced into the third header 313 through the plurality of flat heat transfer tubes 322 between the third header 313 and the fourth header 314. The refrigerant introduced into the third header 313 is introduced into the second header 312 through the second connection port 334, the connecting pipe 335, and the first connection port 333.

In the case where the refrigerant is introduced through the first connection port 333, a pressure of the refrigerant in the upper space 312-2 of the second header 312 is higher than a pressure of the refrigerant in the lower space 312-1 of the second header 312. Therefore, the check valve 210 of the second refrigerant flow control device 200 is not opened, such that the refrigerant may not flow to the lower space 312-1 through the second refrigerant flow control device 200. Specifically, a plunger 216 (see FIG. 6) of the check valve 210 of the second refrigerant flow control device 200 closes a conical hole 213 of a valve seat 211 and a plurality of refrigerant holes 215 of a cylinder 214 by the pressure of the refrigerant, and thus the refrigerant does not flow to the lower space 312-1 of the second header 312-1 through a through-hole 212 of the valve seat 211.

Therefore, the refrigerant introduced into the upper space 312-2 of the second header 312 through the first connection port 333 flows into the upper space 311-2 of the first header 311 through the third flat heat transfer tube group 320-3 corresponding to the upper space 312-2.

The first refrigerant flow control device 100 is disposed on the first baffle 341 partitioning the first header 311 into the upper space 311-2 and the lower space 311-1. Here, a pressure of the refrigerant in the upper space 311-2 of the first header 311 is higher than a pressure of the refrigerant in the lower space 311-1 of the first header 311, and thus the check valve 110 of the first refrigerant flow control device 100 is not opened. As a result, the refrigerant may not flow to the lower space 311-1 of the first header 311 through the first refrigerant flow control device 100 disposed on the first baffle 341. Specifically, the plunger 116 of the check valve 110 of the first refrigerant flow control device 100 closes the conical hole 113 of the valve seat 111 and the plurality of refrigerant holes 115 of the cylinder 114 by the pressure of the refrigerant, and thus the refrigerant does not flow to the lower space 311-1 of the first header 311 through the through-hole 112 of the valve seat 111.

As a result, the refrigerant introduced into the upper space 311-2 of the first header 311 through the third flat heat transfer tube group 320-3 flows into the lower space 312-1 of the second header 312 through the second flat heat transfer tube group 320-2 corresponding a region between the first baffle 341 of the first header 311 and the second baffle 342 of the second header 312.

A lower end of the lower space 312-1 of the second header 312 is blocked, and thus the refrigerant introduced into the lower space 312-1 of the second header 312 is introduced into the lower space 311-1 of the first header 311 through the first flat heat transfer tube group 320-1 corresponding to a region between the first baffle 341 of the first header 311 and the lower end of the second header 312.

The check valve 110 of the first refrigerant flow control device 100 disposed in the lower space 311-1 of the first header 311 is in a closed state, and thus the refrigerant introduced into the lower space 311-1 of the first header 311 may not flow to the upper space 311-2 of the first header 311. Therefore, the refrigerant introduced into the lower space 311-1 of the first header 311 through the first flat heat transfer tube group 320-1 is introduced into the hollow 121 through the refrigerant passages 123 of the side surface of the refrigerant flow rate adjusting member 120 of the first refrigerant flow control device 100, and is discharged to the outside through the first port pipe 331.

As described above, in the case where the heat exchanger 300 according to the embodiment of the disclosure functions as a condenser, the number of turns of the moving path of the refrigerant is total four turns (three turns in the first-row heat exchanger 301 and one turn in the second-row heat exchanger 302).

In the case where the air conditioner is used as a heater, the refrigerant is introduced at a lower portion of the first header 311 of the first-row heat exchanger 301 and is discharged at an upper portion of the fourth header 314 of the second-row heat exchanger 302. That is, the refrigerant is introduced through the first port pipe 331 of the first header 311 of the first-row heat exchanger 301 and discharged through the second port pipe 332 of the fourth header 314 of the second-row heat exchanger 302.

Figure 18:
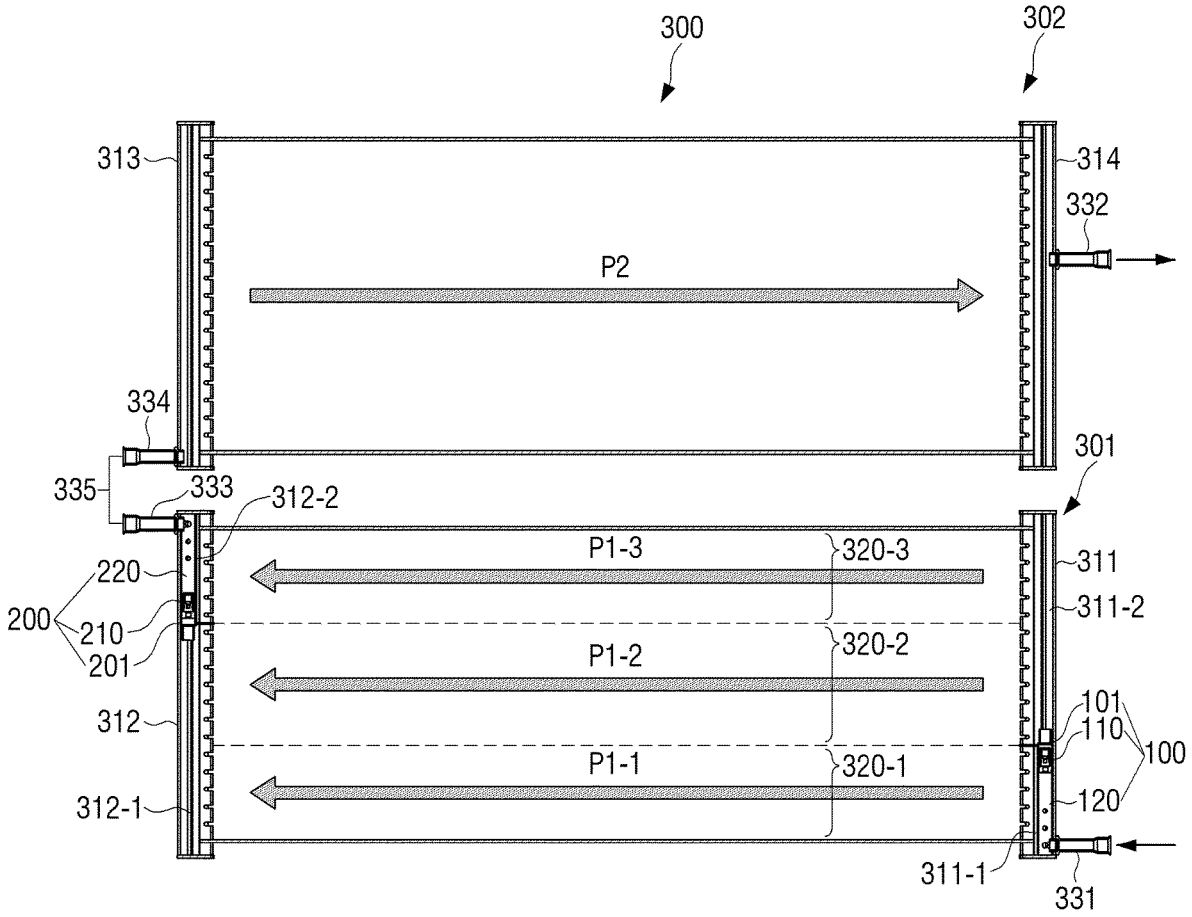
FIG. 18 is a view illustrating the case where the heat exchanger for an air conditioner of FIG. 15 is used as an evaporator.

Specifically, referring to FIG. 18, the refrigerant is introduced into the first header 311 through the first port pipe 331. Here, the first port pipe 331 is connected to the refrigerant flow rate adjusting member 120 of the first refrigerant flow control device 100 disposed on the first baffle 341 of the first header 311, and thus the refrigerant introduced into the first port pipe 331 is introduced into the hollow 121 of the refrigerant flow rate adjusting member 120 of the first refrigerant flow control device 100.

Then, the refrigerant in the refrigerant flow rate adjusting member 120 of the first refrigerant flow control device 100 is introduced into the lower space 311-1 of the first header 311 through the refrigerant passages 123 of the side surface of the refrigerant flow rate adjusting member 120. The refrigerant introduced into the lower space 311-1 of the first header 311 flows into the lower space 312-1 of the second header 312 through the first flat heat transfer tube group 320-1 corresponding to a region between the lower end of the first header 311 and the first baffle 341.

Meanwhile, once the refrigerant is introduced into the first port pipe 331, a pressure of the refrigerant in the refrigerant flow rate adjusting member 120 of the first refrigerant flow control device 100 becomes higher than a pressure of the refrigerant in the upper space 311-2 of the first header 311, and thus the check valve 110 of the first refrigerant flow control device 100 is opened. As a result, the remaining part of the refrigerant introduced into the hollow 121 of the refrigerant flow rate adjusting member 120 flows to the upper space 311-2 of the first header 311 through the check valve 110 of the first refrigerant flow control device 100. Specifically, the plunger 116 of the check valve 110 of the first refrigerant flow control device 100 becomes away from the conical hole 113 of the valve seat 111 to open the plurality of refrigerant holes 115 of the cylinder 114 by the pressure of the refrigerant, and thus the refrigerant flows to the upper space 311-2 of the first header 311 through the through-hole 112 of the valve seat 111 and the plurality of refrigerant holes 115 of the cylinder 114.

Therefore, the refrigerant introduced into the hollow 121 of the refrigerant flow rate adjusting member 120 of the first refrigerant flow control device 100 through the first port pipe 331 flows through two paths. That is, a part of the refrigerant introduced into the hollow 121 of the refrigerant flow rate adjusting member 120 of the first refrigerant flow control device 100 passes through the refrigerant passages 123 of the side surface of the refrigerant flow rate adjusting member 120 of the first refrigerant flow control device 100, and flows to the lower space 312-1 of the second header 312 through the first flat heat transfer tube group 320-1. Meanwhile, the remaining part of the refrigerant introduced into the hollow 121 of the refrigerant flow rate adjusting member 120 of the first refrigerant flow control device 100 is introduced into the upper space 311-2 of the first header 311 through the check valve 110 of the first refrigerant flow control device 100 as described above.

The refrigerant introduced into the upper space 311-2 of the first header 311 through the check valve 110 of the first refrigerant flow control device 100 flows to the second header 312 through the second flat heat transfer tube group 320-2 and the third flat heat transfer tube group 320-3 corresponding to the upper space 311-2 of the first header 311. Specifically, a part of the refrigerant in the upper space 311-2 of the first header 311 is introduced into the lower space 312-1 of the second header 312 through the second flat heat transfer tube group 320-2, and the remaining part of the refrigerant in the upper space 311-2 of the first header 311 is introduced into the upper space 312-2 of the second header 312 through the third flat heat transfer tube group 320-3.

In the case where the refrigerant is introduced through the first port pipe 331 and flows upward in the second header 312, a pressure of the refrigerant in the upper space 312-2 of the second header 312 is lower than a pressure of the refrigerant in the lower space 312-1 of the second header 312. Therefore, the check valve 210 of the second refrigerant flow control device 200 is opened, such that the refrigerant introduced into the lower space 312-1 of the second header 312 through the second flat heat transfer tube group 320-2 may flow to the upper space of the second header 312 through the second refrigerant flow control device 200. Specifically, the plunger 216 of the check valve 210 of the second refrigerant flow control device 200 becomes away from the conical hole 213 of the valve seat 211 by the pressure of the refrigerant to open the plurality of refrigerant holes 215 of the cylinder 214, and thus the refrigerant in the lower space 312-1 of the second header 312 flows to the hollow 221 of the refrigerant flow rate adjusting member 220 disposed on an upper end of the check valve 210 through the through-hole 212 of the valve seat 211 and the plurality of refrigerant holes 215 of the cylinder 214.

Here, the first connection port 333 is directly connected to the refrigerant flow rate adjusting member 220 of the second refrigerant flow control device 200, and thus the refrigerant introduced into the lower space 312-1 of the second header 312 is discharged to the first connection port 333 through the check valve 210 of the second refrigerant flow control device 200 disposed on the second baffle 342, and the refrigerant flow rate adjusting member 220.

Meanwhile, the refrigerant introduced into the upper space 312-2 of the second header 312 through the third flat heat transfer tube group 320-3 is introduced into the hollow 221 through the refrigerant passages 223 formed in the side surface of the refrigerant flow rate adjusting member 220 of the second refrigerant flow control device 200 disposed in the upper space 312-2, and is discharged to the first connection port 333.

The refrigerant discharged to the first connection port 333 is introduced into the third header 313 of the second-row heat exchanger 302 through the connecting pipe 335 and the second connection port 334. The refrigerant introduced into the third header 313 is introduced into the fourth header 314 through the plurality of flat heat transfer tubes 322 between the third header 313 and the fourth header 314. The refrigerant introduced into the fourth header 314 is discharged to the outside of the second-row heat exchanger 302 through the second port pipe 332 disposed on the fourth header 314.

As described above, in the case where the heat exchanger 300 according to the embodiment of the disclosure functions as an evaporator, the number of turns of the moving path of the refrigerant is total two turns (one turn in the first-row heat exchanger 301 and one turn in the second-row heat exchanger 302). Therefore, in the heat exchanger 300 according to the embodiment of the disclosure, the number of turns in the case where the heat exchanger 300 is used as a condenser and the number of turns in the case where the heat exchanger 300 is used as an evaporator may be different from each other. Accordingly, it is possible to significantly reduce a pressure loss to improve heat transfer performance.

In addition, the heat exchanger 300 according to the embodiment of the disclosure further includes the refrigerant flow rate adjusting member 120 and 220 for adjusting a deviation of the refrigerant flow depending on the path in the case where the heat exchanger 300 is used as an evaporator, such that it is possible to lessen evaporation performance deterioration due to the deviation of the refrigerant flow.

Hereinafter, a resistance of each refrigerant moving path in the heat exchanger depending on a presence or absence of the refrigerant flow rate adjusting members 120 and 220 in the case where the two-row heat exchanger 300 according to the embodiment of the disclosure functions as an evaporator will be described with reference to FIGS. 19 and 20.

FIG. 19 is a conceptual view for describing a resistance of each refrigerant moving path in the case where the heat exchanger for an air conditioner according to another embodiment of the disclosure that does not include the refrigerant flow rate adjusting member is used as an evaporator. FIG. 20 is a conceptual view for describing a resistance of each refrigerant moving path in the case where the heat exchanger for an air conditioner according to another embodiment of the disclosure that includes the refrigerant flow rate adjusting member is used as an evaporator.

Referring to FIG. 19, in the heat exchanger 300 functioning as an evaporator, the refrigerant is introduced into the lower space 311-1 of the first header 311 through the first port pipe 331 disposed at the lower portion of the first header 311 of the first-row heat exchanger 301. The refrigerant introduced into the lower space 311-1 of the first header 311 is discharged to the first connection port 333 of the first-row heat exchanger 301 through three moving paths.

Meanwhile, once the refrigerant is introduced into the lower space 311-1 of the first header 311 through the first port pipe 331, the check valve 110 of the first refrigerant flow control device 100 disposed on the first baffle 341 is opened because a pressure of the refrigerant in the lower space 311-1 of the first header 311 is higher than a pressure of the refrigerant in the upper space 311-2 of the first header 311. Further, a pressure of the refrigerant in the lower space 312-1 of the second header 312 is also higher than a pressure of the refrigerant in the upper space 312-2 of the second header 312, and thus the check valve 210 of the second refrigerant flow control device 200 disposed on the second baffle 342 is also opened.

Therefore, a part of the refrigerant in the lower space 311-1 of the first header 311 is introduced into the lower space 312-1 of the second header 312 through the first flat heat transfer tube group 320-1, and the refrigerant introduced into the lower space 312-1 of the second header 312 flows to the upper space 312-2 of the second header 312 through the check valve 210 of the second refrigerant flow control device 200 (first moving path) (Path1).

Further, the remaining part of the refrigerant in the lower space 311-1 of the first header 311 is introduced into the upper space 311-2 of the first header 311 through the check valve 110 of the first refrigerant flow control device 100 disposed on the first baffle 341.

A part of the refrigerant introduced into the upper space 311-2 of the first header 311 is introduced into the lower space 312-1 of the second header 312 through the second flat heat transfer tube group 320-2, and the refrigerant introduced into the lower space 312-1 of the second header 312 flows to the upper space 312-2 of the second header 312 through the check valve 210 of the second refrigerant flow control device 200 (second moving path) (Path2).

Finally, the remaining part of the refrigerant introduced into the upper space 311-2 of the first header 311 moves to the upper space 312-2 of the second header 312 through the third flat heat transfer tube group 320-3 (third moving path) (Path3).

The refrigerant introduced into the upper space 312-2 of the second header 312 through the three moving paths is introduced into the third header 313 of the second-row heat exchanger 302 through the first connection port 333 of the second header 312. The refrigerant introduced into the third header 313 flows to the fourth header 314 through the plurality of flat heat transfer tubes 322 of the second-row heat exchanger 302. The refrigerant introduced into the fourth header 314 is discharged to the outside of the second-row heat exchanger 302 through the second port pipe 332.

Therefore, in the case where the refrigerant introduced through the first port pipe 331 of the first header of the first-row heat exchanger 301 is discharged to the second port pipe 332 of the fourth header 314 of the second-row heat exchanger 302 through the above-described three moving paths, a resistance applied to the refrigerant moving through each moving path may be represented as follows.

$$R\text{-Path1}=R_\text{hex}_1+R3+R_\text{hex}4$$

$$R\text{-Path2}=R2+R_\text{hex}2+R3+R_\text{hex}4$$

$$R\text{-Path3}=R2+R_\text{hex}3+R_\text{hex}4$$

Here, R-Path1 represents a resistance applied to the refrigerant moving through the first moving path, R-Path2 represents a resistance applied to the refrigerant moving through the second moving path, R-Path3 represents a resistance applied to the refrigerant moving through the third moving path, R_hex1 represents a resistance applied to the refrigerant moving from the first header to the second header through the first flat heat transfer tube group, R_hex2 represents a resistance applied to the refrigerant moving from the first header to the second header through the second flat heat transfer tube group, R_hex3 represents a resistance applied to the refrigerant moving from the first header to the second header through the third flat heat transfer tube group, R_hex4 represents a resistance applied to the refrigerant moving from the third header to the fourth header through the plurality of flat heat transfer tubes, R2 represents a resistance applied to the refrigerant at the time of passing through the first refrigerant flow control device, and R3 represents a resistance applied to the refrigerant at the time of passing through the second refrigerant flow control device.

The first, second, and third flat heat transfer tube groups 320-1, 320-2, and 320-3 have structures similar to each other or same as each other, and thus R_hex1, R_hex2, and R_hex3 are substantially the same as one another. Further, the first refrigerant flow control device 100 and the second refrigerant flow control device 200 also have structures similar to each other or same as each other, and thus R2 and R3 are substantially the same as each other. Accordingly, R-Path1, R-Path2, and R-Path3 have the following relationship.

$$R\text{-Path2}>R\text{-Path1}\approx R\text{-Path3}$$

As can be appreciated from the above expression, a resistance of the second moving path is higher than a resistance of the third moving path and a resistance of the first moving path, and the resistance of the third moving path and the resistance of the first moving path are similar to each other. In the case where the resistances of the three moving paths are different from one another as described above, an amount of refrigerant moving through the second moving path is decreased because the refrigerant tends to move to a path with a lower resistance. Therefore, a flow of the refrigerant moving through the three moving paths is not uniform and the deviation of the refrigerant flow is generated, which is problematic.

Referring to FIG. 20, in the heat exchanger 300 functioning as an evaporator, the refrigerant is introduced through the first port pipe 331 of the first header 311 of the first-row heat exchanger 301. Here, the first port pipe 331 is connected to the refrigerant flow rate adjusting member 120 of the first refrigerant flow control device 100 disposed on the first baffle 341 of the first header 311, and thus the refrigerant is introduced into the hollow 121 of the refrigerant flow rate adjusting member 120 through the first port pipe 331. The refrigerant introduced into the hollow 121 of the refrigerant flow rate adjusting member 120 of the first refrigerant flow control device 100 is discharged to the first connection port 333 of the first-row heat exchanger 301 through three moving paths.

Meanwhile, once the refrigerant is introduced into the hollow 121 of the refrigerant flow rate adjusting member 120 of the first refrigerant flow control device 100 through the first port pipe 331, the check valve 110 of the first refrigerant flow control device 100 disposed on the first baffle 341 is opened because a pressure of the refrigerant in the lower space 311-1 of the first header 311 is higher than a pressure of the refrigerant in the upper space 311-2 of the first header 311. Further, a pressure of the refrigerant in the lower space 312-1 of the second header 312 is also higher than a pressure of the refrigerant in the upper space 312-2 of the second header 312, and thus the check valve 210 of the second refrigerant flow control device 200 disposed on the second baffle 342 is also opened.

Therefore, a part of the refrigerant in the hollow 121 of the refrigerant flow rate adjusting member 120 of the first refrigerant flow control device 100 is introduced into the lower space 312-1 of the second header 312 through the refrigerant passages 123 of the side surface of the refrigerant flow rate adjusting member 120 and the first flat heat transfer tube group 320-1, and the refrigerant introduced into the lower space of the second header 312 flows to the hollow 221 of the refrigerant flow rate adjusting member 220 of the second refrigerant flow control device 200 through the check valve 210 of the second refrigerant flow control device 200 (first moving path) (Path1).

Further, the remaining part of the refrigerant in the hollow 121 of the refrigerant flow rate adjusting member 120 of the first refrigerant flow control device 100 is introduced into the upper space 311-2 of the first header 311 through the check valve 110 of the first refrigerant flow control device 100 disposed on the first baffle 341.

A part of the refrigerant introduced into the upper space 311-2 of the first header 311 is introduced into the lower space 312-2 of the second header 312 through the second flat heat transfer tube group 320-2, and the refrigerant introduced into the lower space 312-1 of the second header 312 flows to the hollow 221 of the refrigerant flow rate adjusting member 220 of the second refrigerant flow control device 200 through the check valve 210 of the second refrigerant flow control device 200 (second moving path) (Path2).

Finally, the remaining part of the refrigerant introduced into the upper space 311-2 of the first header 311 moves to the upper space 312-2 of the second header 312 through the third flat heat transfer tube group 320-3, and then is introduced into the hollow 221 of the refrigerant flow rate adjusting member 220 through the refrigerant passages 223 of the side surface of the refrigerant flow rate adjusting member 220 of the second refrigerant flow control device 200 (third moving path) (Path3).

The refrigerant introduced into the hollow 221 of the refrigerant flow rate adjusting member 220 of the second refrigerant flow control device 200 through the three moving paths is introduced into the third header 313 of the second-row heat exchanger 302 through the first connection port 333 of the second header 312. The refrigerant introduced into the third header 313 flows to the fourth header 314 through the plurality of flat heat transfer tubes 322 of the second-row heat exchanger 302. The refrigerant introduced into the fourth header 314 is discharged to the outside of the second-row heat exchanger 302 through the second port pipe 332.

Therefore, in the case where the refrigerant introduced through the first port pipe 331 of the first header 311 of the first-row heat exchanger 301 is discharged to the second port pipe 332 of the fourth header 314 of the second-row heat exchanger 302 through the above-described three moving paths, a resistance applied to the refrigerant moving through each moving path may be represented as follows.

$$R\text{-Path1}=R1+R_\text{hex1}+R3+R_\text{hex4}$$

$$R\text{-Path2}=R2+R_\text{hex2}+R3+R_\text{hex4}$$

$$R\text{-Path3}=R2+R_\text{hex3}+R4+R_\text{hex4}$$

Here, R-Path1 represents a resistance applied to the refrigerant moving through the first moving path, R-Path2 represents a resistance applied to the refrigerant moving through the second moving path, R-Path3 represents a resistance applied to the refrigerant moving through the third moving path, R-hex1 represents a resistance applied to the refrigerant moving from the first header to the second header through the first flat heat transfer tube group, R-hex2 represents a resistance applied to the refrigerant moving from the first header to the second header through the second flat heat transfer tube group, R-hex3 represents a resistance applied to the refrigerant moving from the first header to the second header through the third flat heat transfer tube group, R-hex4 represents a resistance applied to the refrigerant moving from the third header to the fourth header through the plurality of flat heat transfer tubes, R1 represents a resistance applied to the refrigerant at the time of passing through the refrigerant passages of the side surface of the refrigerant flow rate adjusting member of the first refrigerant flow control device, R2 represents a resistance applied to the refrigerant at the time of passing through the check valve of the first refrigerant flow control device, R3 represents a resistance applied to the refrigerant at the time of passing through the check valve of the second refrigerant flow control device, and R4 represents a resistance applied to the refrigerant at the time of passing through the refrigerant passages of the side surface of the refrigerant flow rate adjusting member of the second refrigerant flow control device.

The first, second, and third flat heat transfer tube groups 320-1, 320-2, and 320-3 have structures similar to each other or same as each other, and thus R_hex1, R_hex2, and R_hex3 are substantially the same as one another. Further, the first refrigerant flow control device 100 and the second refrigerant flow control device 200 also have structures similar to each other or same as each other, and thus R2 and R3 are substantially the same as each other. Accordingly, in the case where R1 and R2 are similar to each other and R4 and R3 are similar to each other, R-Path1, R-Path2, and R-Path3 may have the following relationship.

$$R\text{-Path2}\approx R\text{-Path1}\approx R\text{-Path3}$$

That is, in the heat exchanger 300 according to the embodiment of the disclosure, the resistances applied to the refrigerant moving through the three moving paths may become substantially uniform by adjusting the resistance of each of the refrigerant passages 123 the refrigerant flow rate adjusting members 120 of the refrigerant flow control device 100, and the refrigerant passages 223 the refrigerant flow rate adjusting members 220 of the refrigerant flow control device 200. As such, in the case where the resistances applied to the refrigerant moving through the three moving paths, that is, the first moving path, the second moving path, and the third moving path, are similar to each other or the same as each other, the refrigerant flow may become substantially uniform.

Hereinabove, the disclosure has been described for illustrative purpose. It is to be understood that terms used herein are provided to describe the disclosure rather than limiting the disclosure. Various modifications and alternations of the disclosure may be made according to the contents described above. Therefore, the disclosure may be freely practiced without departing from the scope of the claims unless additionally mentioned.

What is claimed is:

1. A heat exchanger comprising:

a plurality of flat heat transfer tubes through which a refrigerant flows;

a plurality of fins configured to be arranged on outer surfaces of the plurality of flat heat transfer tubes;

a first header and a second header configured to be disposed on opposite ends of the plurality of flat heat transfer tubes, respectively;

baffles including a first baffle and a second baffle being disposed in the first header and a third baffle being disposed in the second header, the baffles being configured to prevent refrigerant from passing therethrough and to partition an inner space of the first header and the second header; and refrigerant flow control devices including a first refrigerant flow control device and a second refrigerant flow control device configured to allow the refrigerant to selectively pass through a respective baffle from among the first baffle, the second baffle, and the third baffle and control a flow of the refrigerant, the first refrigerant flow control device being disposed on the third baffle and the second refrigerant flow control device being disposed on the second baffle, wherein each of the refrigerant flow control devices is configured to:

block the flow of the refrigerant to prevent the refrigerant from passing through the refrigerant flow control device in a case where the refrigerant flows in one direction in a corresponding header from among the first header and the second header, allow the refrigerant to pass through the respective baffle through the refrigerant flow control device in a case where the refrigerant flows in a direction opposite to the one direction in the corresponding header, and control a flow rate of the refrigerant passing through the refrigerant flow control device, wherein each of the refrigerant flow control devices includes:

a communicating pipe disposed on the respective baffle, a check valve disposed in the communicating pipe and opening and closing the communicating pipe depending on a flow direction of the refrigerant, and a refrigerant flow rate adjusting member disposed on one end of the communicating pipe, having a hollow cylindrical shape communicating with the communicating pipe, and having a side surface in which refrigerant passages through which the refrigerant passes are formed, wherein the heat exchanger is configured such that, in response to introducing the refrigerant into a lower space of the first header, the refrigerant flows to a lower space of the second header through at least one flat heat transfer tube of the plurality of flat heat transfer tubes positioned below the first baffle, and wherein a part of the refrigerant moving to the lower space of the second header flows to a middle space of the first header through the refrigerant passages of the refrigerant flow rate adjusting member of the first refrigerant flow control device and through at least one flat heat transfer tube of the plurality of flat heat transfer tubes positioned between the first baffle and the third baffle and is discharged through the check valve of the second refrigerant flow control device.

2. The heat exchanger of claim 1, wherein the check valve includes:

a valve seat fixed in the communicating pipe and having a through-hole;

a cylinder extending vertically from the valve seat and having an outer circumferential surface in which a plurality of refrigerant holes are formed; and a plunger slidably disposed in the cylinder to selectively close the through-hole of the valve seat depending on the flow direction of the refrigerant, and wherein, when the refrigerant flows in the direction opposite to the one direction in the corresponding header, the refrigerant lifts the plunger to pass through the communicating pipe through the through-hole of the valve seat, and the plurality of refrigerant holes of the cylinder.

3. The heat exchanger of claim 2, wherein a conical hole is formed on one side of the through-hole, and a conical portion having a conical shape corresponding to the conical hole of the through-hole is formed at one end of the plunger.

4. The heat exchanger of claim 2, wherein a stopper limiting a movement of the plunger is formed at one end of the cylinder.

5. The heat exchanger of claim 2, wherein a groove is formed along an entire circumference of an outer circumferential surface of the valve seat, and a protrusion engaged with the groove of the valve seat is formed on the communicating pipe.

6. The heat exchanger of claim 1, wherein a first port pipe and a second port pipe through which the refrigerant flows in or out are disposed on a lower end portion and an upper end portion of the first header, respectively, wherein the first refrigerant flow control device is disposed on the third baffle of the second header, and wherein the second refrigerant flow control device is located adjacent to the second port pipe.

7. The heat exchanger of claim 6, wherein the refrigerant flow rate adjusting member of the first refrigerant flow control device extends toward a lower end of the second header, and wherein the refrigerant flow rate adjusting member of the second refrigerant flow control device extends toward an upper end of the first header.

8. The heat exchanger of claim 7, wherein the refrigerant flow rate adjusting member of the second refrigerant flow control device is connected to the second port pipe.

9. The heat exchanger of claim 8, wherein a remaining part of the refrigerant moving to the lower space of the second header flows to an upper space of the second header through the check valve of the first refrigerant flow control device, wherein a part of the refrigerant flowing to the upper space of the second header flows to the middle space of the first header through at least one flat heat transfer tube of the plurality of flat heat transfer tubes positioned between the third baffle and the second baffle and is discharged to the second port pipe through the check valve of the second refrigerant flow control device, and wherein a remaining part of the refrigerant flowing to the upper space of the second header flows to an upper space of the first header through at least one flat heat transfer tube of the plurality of flat heat transfer tubes positioned over the second baffle and is discharged to the second port pipe through the refrigerant passages of the refrigerant flow rate adjusting member of the second refrigerant flow control device.

10. The heat exchanger of claim 7, wherein, as a distance from the check valve increases, an area of each through-hole of a plurality of through-holes of the refrigerant flow rate adjusting member of the second refrigerant flow control device increases.

11. The heat exchanger of claim 1, wherein the refrigerant flow rate adjusting member is implemented by a hollow refrigerant pipe, and a plurality of through-holes are formed in the hollow refrigerant pipe as the refrigerant passages.

12. The heat exchanger of claim 1, wherein the refrigerant flow rate adjusting member is a hollow porous pipe.

13. The heat exchanger of claim 1, wherein a length from the third baffle to one end of the refrigerant flow rate adjusting member of the second header is determined to allow the one end of the refrigerant flow rate adjusting member to be in contact with a horizontal virtual plane extending from the first baffle disposed in the first header.

14. An air conditioner comprising:

a housing; and a heat exchanger;

wherein the heat exchanger is disposed in the housing of the air conditioner, and wherein the heat exchanger comprises:

a plurality of flat heat transfer tubes through which a refrigerant flows;

a plurality of fins configured to be arranged on outer surfaces of the plurality of flat heat transfer tubes;

a first header and a second header configured to be disposed on opposite ends of the plurality of flat heat transfer tubes, respectively;

baffles including a first baffle and a second baffle being disposed in the first header and a third baffle being disposed in the second header, the baffles being configured to prevent refrigerant from passing therethrough and to partition an inner space of the first header and the second header; and refrigerant flow control devices including a first refrigerant flow control device and a second refrigerant flow control device configured to allow the refrigerant to selectively pass through a respective baffle from among the first baffle, the second baffle, and the third baffle and control a flow of the refrigerant, the first refrigerant flow control device being disposed on the third baffle and the second refrigerant flow control device being disposed on the second baffle, wherein each of the refrigerant flow control devices is configured to:

block the flow of the refrigerant to prevent the refrigerant from passing through the refrigerant flow control device in a case where the refrigerant flows in one direction in a corresponding header from among the first header and the second header, allow the refrigerant to pass through the respective baffle through the refrigerant flow control device in a case where the refrigerant flows in a direction opposite to the one direction in the corresponding header, and control a flow rate of the refrigerant passing through the refrigerant flow control device, wherein each of the refrigerant flow control devices includes:

a communicating pipe disposed on the respective baffle, a check valve disposed in the communicating pipe and opening and closing the communicating pipe depending on a flow direction of the refrigerant, and a refrigerant flow rate adjusting member disposed on one end of the communicating pipe, having a hollow cylindrical shape communicating with the communicating pipe, and having a side surface in which refrigerant passages through which the refrigerant passes are formed, wherein the heat exchanger is configured such that, in response to introducing the refrigerant into a lower space of the first header, the refrigerant flows to a lower space of the second header through at least one flat heat transfer tube of the plurality of flat heat transfer tubes positioned below the first baffle, and wherein a part of the refrigerant moving to the lower space of the second header flows to a middle space of the first header through the refrigerant passages of the refrigerant flow rate adjusting member of the first refrigerant flow control device and through at least one flat heat transfer tube of the plurality of flat heat transfer tubes positioned between the first baffle and the third baffle and is discharged through the check valve of the second refrigerant flow control device.

* * * * *